US005915147A

United States Patent [19]

Kouno et al.

[11] Patent Number: 5,915,147

[45] Date of Patent: Jun. 22, 1999

[54] IMAGE FIXING DEVICE, IMAGE FORMING APPARATUS PROVIDING THE IMAGE FIXING DEVICE AND ROTOR USED IN THE IMAGE FIXING DEVICE AND HAVING INDUCTION COIL INSIDE

[75] Inventors: Yuzou Kouno, Kamagaya; Toshiaki Higaya, Kawasaki; Hiroshi Yokoyama, Yokohama; Jyunji Nakai, Yokohama; Keizou Yasuda, Yokohama; Masahiko Sato, Funabashi; Masanao Ehara, Yokohama; Takayuki Seki, Yokohama, all of Japan

[73] Assignee: Ricoh Company, Ltd., Tokyo, Japan

[21] Appl. No.: 09/092,052

[22] Filed: Jun. 5, 1998

Related U.S. Application Data

[63] Continuation of application No. 08/759,929, Dec. 4, 1996, Pat. No. 5,832,354.

[30] Foreign Application Priority Data

| | | | |
|---|---|---|---|
| Dec. 5, 1995 | [JP] | Japan | 7-316643 |
| Dec. 5, 1995 | [JP] | Japan | 7-316766 |
| Dec. 6, 1995 | [JP] | Japan | 7-318129 |
| Dec. 7, 1995 | [JP] | Japan | 7-318853 |
| Dec. 7, 1995 | [JP] | Japan | 7-318947 |
| Dec. 8, 1995 | [JP] | Japan | 7-320037 |
| Dec. 8, 1995 | [JP] | Japan | 7-320037 |
| Dec. 25, 1995 | [JP] | Japan | 7-336424 |
| Nov. 28, 1996 | [JP] | Japan | 8-317973 |
| Nov. 29, 1996 | [JP] | Japan | 8-319206 |

[51] Int. Cl.[6] ..... G03G 15/20

[52] U.S. Cl. ..... 399/69; 399/330; 399/333; 219/619

[58] Field of Search ..... 399/330, 328, 399/333, 69, 67; 219/216, 619, 671

[56] References Cited

U.S. PATENT DOCUMENTS

| | | | |
|---|---|---|---|
| 3,809,855 | 5/1974 | Neal . | |
| 4,425,489 | 1/1984 | Pav et al. . | |
| 5,303,016 | 4/1994 | Oda et al. . | |
| 5,393,959 | 2/1995 | Kitano et al. . | |
| 5,526,103 | 6/1996 | Kato et al. . | |
| 5,552,582 | 9/1996 | Abe et al. . | |
| 5,553,729 | 9/1996 | Kitano et al. . | |
| 5,568,240 | 10/1996 | Ohtsuka . | |
| 5,752,150 | 5/1998 | Kato et al. | 399/330 |
| 5,768,673 | 6/1998 | Morigami | 399/330 |
| 5,778,293 | 7/1998 | Ohtsuka | 219/619 X |
| 5,819,150 | 10/1998 | Hayasaki et al. | 399/330 |
| 5,822,669 | 10/1998 | Okabayashi et al. | 399/330 |

*Primary Examiner*—Matthew S. Smith

*Attorney, Agent, or Firm*—Oblon, Spivak, McClelland, Maier & Neustadt, P.C.

[57] ABSTRACT

The present invention is intended to solve a problem in that the response in the temperature detection in the rotor having the induction coil inside the durability in the rotor and a stain temperature detection means in the rotor is affected by the magnetic flux of an induction heating mechanism.

The invention provides an image fixing device having an induction coil inside of a rotor 11 which is rotatably supported, the device having inside of the rotor 11 at least one of temperature detection means 17 for detecting the temperature of the rotor 11 or temperature over-rise preventing detection means 18 for detecting that the temperature of the rotor 11 has risen to a predetermined temperature.

8 Claims, 18 Drawing Sheets

IMAGE FIXING DEVICE, IMAGE FORMING APPARATUS PROVIDING THE IMAGE FIXING DEVICE AND ROTOR USED IN THE IMAGE FIXING DEVICE AND HAVING INDUCTION COIL INSIDE

This application is a continuation of application Ser. No. 08/759,929, filed on Dec. 4, 1996 now U.S. Pat. No. 5,832,354.

BACKGROUND OF THE INVENTION

1. Field of the Invention

The present invention relates to an image fixing device in an electron photographic image forming apparatus such as a copying machine, a facsimile machine, a printer or the like and more particularly, to an image fixing apparatus using an electromagnetic induction heating, an image forming apparatus providing an image fixing device, and a rotor used in the image fixing device having inside thereof an induction coil.

2. Description of the Related Art

In an image forming apparatus such as a copying machine, a facsimile machine, a printer or the like, generally a toner image is formed on a recording material so that the toner image on the recording material is fixed to the recording material with the image fixing device. This image fixing device includes a heating image fixing device having two fixing rollers, and other kinds of image fixing device. The heating image fixing device having the two rollers fixes the toner image on the recording material to the recording material with heating by the heating rollers having two fixing rollers when the recording material passes through a nib part of the two fixing rollers.

For example, as disclosed in Japanese Patent Application Laid-Open No. 48-59458, there is available a heating roller in this kind of image fixing device which is constituted to incorporate in a main body of a hollow-shaped roller comprising a non-magnetic material an electromagnetic induction heating mechanism comprising an iron core as a shaft shaft and an induction coil which is wound on the iron core. When the induction coil is excited with an alternate current, there is available a heating roller wherein a magnetic flux passes through an internal circumferential wall of the main body of the roller which faces the induction coil, and an alternate current is induced along the circumferential direction and the main body of the roller is heated. In addition, in the image fixing device, it is necessary to maintain the set temperature of the heating roller to a definite level from the viewpoint of uniforming the fixing accuracy (and uniforming the image quality as a result). For example, Japanese Patent Application Laid-Open No. 51-90043 discloses an art wherein the surface temperature of the heating roller is detected with a temperature sensing device which is pressed and is brought into contact with an arbitrary position of the roller surface, and a power input to the induction coil is controlled with a temperature control means on the basis of the detected value.

Furthermore, Japanese Patent Application Laid-Open No. 53-63032 describes a heating roller comprising a jacket which is formed by combining an internal cylinder and an external cylinder to seal a caliber part of one end between both cylinders, a thermal carrier which is sealed in the jacket, and, means for controlling a temperature of a heating part by heating a heating part comprising both cylinders with an induction coil wound around a core which is disposed around the inside of the internal cylinder and detecting an internal pressure of the jacket having an increasing pressure with a temperature detection means including bellows.

Japanese Patent Application Laid-Open No. 53-50844 discloses an art for quickening a rise of the heating roller and eliminating a lack in the strength of a heating layer by providing a heating roller comprising a winding wound around a core comprising a magnetic body fixed to a shaft, a heat insulating layer comprising an elastic body which is arranged on an external circumference of the winding, and a flexible induction heating layer which covers the heat insulating layer.

The heating roller described in the aforementioned Japanese Patent Application Laid-Open No. 53-50844 has a problem in that the cost of the heating roller is high because the heating roller has a structure in which the whole roller including a core part has an integrated structure, and the cost of the heating roller replacement is high because the heating roller as a whole must be replaced at the time of replacing the heating roller.

The heating roller which is described in Japanese Patent Application Laid-Open No. 6-60957 has a core part and an external circumference part as separate entities. When the external circumference part of the heating roller is deteriorated, only the external circumference part may be replaced so that the roller can be replaced at a low cost. However, a thickness of a part where joule heat is generated is thick, and the heat capacity is large so that there is a problem in that the so-called rise time becomes long for realizing a desired fixing temperature.

In addition, the heating roller described in the aforementioned Japanese Patent Application Laid-Open No. 53-50844 is constituted so that the heat insulation layer is arranged only at each end part of the induction heat layer, and a central part of the heating roller is curved in a convex-shape with the result that paper is fed in a stable manner by allowing force to act in a direction of spreading the paper at the time of paper feeding.

Japanese Patent Application Laid-Open No. 2-12791 describes an induction heat roller having a jacket chamber provided on a circumferential surface of a roller which is rotatably supported, the jacket chamber having a two phase thermal carrier in a gas and a liquid state uniformly in an axial direction of the roller; a plurality of induction heat mechanism arranged inside of the roller in an axial direction: and a swell and shrinkage mechanism which either swells or shrinks in a radial direction the roller on an internal surface wall in the roller between the plurality of the induction heat mechanism, wherein the induction heat roller is used as a fixing roller of the heating and image fixing device so that a bending amount by a pressure of the nib part is corrected.

The image fixing device described in Japanese Patent Application Laid-Open No. 53-63032 has the following problems.

a. The temperature of the heating roller is detected with a thermistor or the like outside of the heating roller and a rise of the temperature of the heating roller is detected with the temperature fuse so that the response of the temperature detection is not favorable.

b. In addition, in the case where a separation layer is provided on a surface of the heating roller, the separation layer is damaged with a thermistor or the like so that the endurance of the heating roller is deteriorated.

c. Furthermore, a stain is generated on a part where the temperature is detected with the thermistor of the heating roller or the like so that it is necessary to clean the part at the time of the maintenance.

Therefore, it is thought to provide a temperature fuse or a thermistor on a paper unfeeding part (where paper does not pass through) of the heating roller to improve the aforementioned disadvantages b and c. In such a case, the temperature at a central part of the heating roller cannot be accurately detected. In addition, in the case where the heating roller is heated with a radiation heat from the outside of the heating roller by means of a halogen heater, the inside of the heating roller becomes high so that there arises a problem in that some device which is to be provided inside of the heating roller suffers from a problem in the heat insulation properties.

In addition, the internal pressure of the jacket is detected with the temperature detecting device including bellows so that the temperature of the heating part is controlled. Consequently, the temperature detection accuracy is not favorable and the device becomes very large. Furthermore, the heating part is heated with the induction coil so that a detection error of the temperature detection means is likely to be generated under an influence of the magnetic flux of induction heating from the induction coil in the case where the temperature detection means used in the device comprises a device formed of a conductive material such as a thermistor or the like.

SUMMARY OF THE INVENTION

A first object of the invention is to provide an image fixing device which has a good response in temperature detection, and is capable of improving an endurance of the roller and the temperature detection means and is capable of removing completely stains on the roller so that the temperature detection accuracy can be improved, as well as an image forming apparatus providing the aforementioned image fixing device, and a rotor which is provided in the image fixing device and which has an induction coil inside thereof.

A second object of the invention is to provide an image fixing device wherein a magnetic flux generated at the time of induction heating does not affect the temperature detection means and the temperature detection accuracy is improved, as well as an image fixing device, an image forming apparatus providing the aforementioned image fixing device and a rotor having inside an induction coil.

A third object of the invention is to provide an image fixing device wherein a response of the temperature overrise preventing means has been improved.

A fourth object of the invention is to provide an image fixing device wherein the temperature detection means is alienated from the scope of the influence of the electromagnetic induction heating mechanism as much as possible so that the influence can be minimized and the temperature can be accurately detected, as well as an image forming apparatus providing the aforementioned image fixing device and a rotor which is used in the image fixing device and has an induction coil inside.

A fifth object of the invention is to provide an image fixing device wherein the periphery of the temperature detection means is sealed from the magnetic field so that the influence of the electromagnetic heating mechanism is minimized and the temperature can be detected accurately, as well as an image forming apparatus providing the image fixing device and a rotor which is used in the image fixing device and which has an induction coil inside.

In the art described in Japanese Patent Application Laid-Open No. 53-50844, the heating layer is made flexible to quicken the rise of the heating roller and the heating layer is supported with an elastic body such as a silicone rubber, a fluorine rubber or the like so as to endure pressure when used as a fixing roller pair. With such a structure, the rise time can be quickened while keeping the function of the fixing roller pair.

However, the elastic body is used in a support part of the heating layer so that it is not possible to avoid the generation of a phenomenon that the heating layer (metal thin layer) cannot accomplish the function.

A sixth object of the invention is to provide a rotor which is efficient and suitable for the heat roller pair, the rotor having an induction coil inside thereof which is favorable for the replacement.

A seventh object of the invention is to provide a rotor which improves the replacement and can secure an attachment position accuracy, the rotor having an induction coil inside.

An eighth object of the invention is to provide a rotor having an inductin coil inside which can simplify a support method in addition to the seventh object.

A ninth object of the invention is to provide a rotor whose yield ratio is improved and which can be produced stably at the time of producing a large amount of rotors according to claim 17 which has an induction coil inside.

A tenth object of the invention is to provide a rotor whose weight is decreased and whose handling is improved, the rotor having an induction inside.

An eleventh object of the invention is to provide a rotor wherein the rotor is damaged when the rotor is overheated because of the failure of the temperature control mechanism or the like and an accident of the scattering of the rotor pair pressed at a high pressure can be prevented.

A twelfth object of the invention is to provide an image fixing device which is capable of shortening a so-called rise time and which is capable of realizing a fast, easy and low-cost replacement of rotors wherein a desired fixing temperature is realized on a surface of a rotor which has an induction coil inside.

The thickness of the rotor of the image forming apparatus which has the induction coil inside, particularly, the thickness of the rotor itself becomes thin. The thickness is one factor which affects the amount of the accumulated heat. There arises a problem in that the heat radiation amount will be large at the end part of the axial direction of the rotor in the case where the thickness is thin, and the temperature distribution cannot be made uniform in the axial direction with an increase in the temperature gradient.

The rotor having the induction coil inside uses a good conductor such as aluminum or iron as a core, so that the heat conduction is not lowered. On the surface of the core, a separation layer is formed of Teflon (product name) having a separation action. However, there is a case in that the fixing efficiency becomes worse because the contact area with the image on the recording material which is fixed material can not be taken in a large area depending on the material used in the separation layer.

The use of rubber which can be elastically deformed can be considered to enlarge the contact area with the image on the recording medium.

However, the heat conduction to the image cannot be favorably conducted because the heat conduction of the rubber is extremely low. Besides, when paper is fed continuously because the temperature rise is poor, it is difficult to set the temperature of the surface of the rotor to a temperature required for fixing until the next recording medium comes.

On the other hand, causes for the worsening of the rise of the temperature required for fixing include a rotor having an induction coil inside, the rotor which is constituted in contact with an image fixing device in addition to causes on the side of the rotor having an induction coil inside.

Normally, the aforementioned rotor is constituted so that the surface has an elastic property to some extent because the rotor has a function of allowing the recording material to be pressed against the rotor having the induction coil inside. As a material having the elastic property, the aforementioned rubber can be used. However, the material has a poor rise in temperature because of the aforementioned reasons, and it is hard to obtain temperature required for fixing the image because of the loss of heat from the rotor having the induction coil inside.

A thirteenth object of the invention is to provide a fixing roller which can obtain a uniform temperature distribution in an axial direction and which is favorable in mass production in view of the problem in the aforementioned prior art rotor having the induction coil and the image fixing device.

A fourteenth object of the invention is to provide a rotor having an induction coil inside which is capable of improving the temperature rise on the surface when a material having a low heat conduction such as rubber or the like on the surface.

A fifteenth object of the invention is to provide a rotor having an induction coil which is capable of improving the heat conduction on the surface.

A sixteenth object of the invention is to provide an image fixing device which is capable of reducing the temperature gradient between rotors with heating on the side of the other rotor in addition to the rotor having an induction coil inside.

In the heating roller described in the aforementioned Japanese Patent Application Laid-Open No. 53-50844, the heat insulation layer is arranged only at each end part of the induction heat layer and the central part of the heating roller is curved in a convex shape so that the paper is fed stably by acting a force in a direction of spreading the recording material at the time of feeding the paper. The appropriate amount of curving the central part of the heating roller differs depending on the recording material conditions such as the recording paper size or the like so that the roller cannot correspond to the size of each kind of recording material.

Furthermore, in the induction heating roller described in the aforementioned Japanese Patent Application Laid-Open No. 2-12791, a jacket chamber is provided which seals the two-phase thermal carrier in the liquid state and the gas state uniformly in an axial direction to the circumferential wall of the roller which is rotatably supported. Inside of this roller, a plurality of induction heating mechanism is arranged in the axial direction and a swelling and shrinking mechanism is provided which either swells or shrinks the aforementioned roller in a radial direction to the internal circumferential wall of the aforementioned roller between the plurality of the induction heating mechanisms. Consequently, even if an attempt is made to swell or shrink the roller in the radial direction with the plurality of induction heating mechanism which is arranged inside in the axial direction, the roller cannot be partially swollen or shrunken because the jacket chamber is uniform in the axial direction with the result that the bent amount of the roller cannot be corrected and the recording material cannot be fed stably.

A seventeenth object of the invention is to provide an image fixing device which has improved the stability in the feeding of the recording material, an image forming apparatus providing the aforementioned image fixing device, and a rotor which is used in the image fixing device and has an induction coil inside thereof.

An eighteenth object of the invention is to provide an image fixing device which is capable of arbitrarily changing the heating distribution and the uneven shape of the rotor surface having an induction coil inside.

A ninteenth object of the invention is to provide an image fixing device wherein part of the rotor having an induction coil inside is not heated and energy is saved.

A twentieth object of the invention is to provide an image fixing device wherein a rotor having an induction coil is most appropriately swollen and an attempt is made to save energy.

A twenty-first object of the invention is to provide an image fixing device wherein the rotor having an induction coil is swollen to the most appropriate amount suitable to the condition of the recording material and the stability of the feeding of the recording material is stabilized and energy is saved.

A twenty-second object of the invention is to provide an image fixing device wherein the rotor having the induction coil is swollen depending on a part where the toner image exits and energy is saved.

A twenty-third object of the invention is to provide an image fixing device wherein the surface temperature of the rotor having an induction coil inside is controlled independently for each part which is induced and heated with each induction heating mechanism.

A twenty-fourth object of the invention is to provide an image fixing device which is capable of functioning a safety mechanism with a temperature fuse even when either of two or more independent induction heating mechanim runs away.

A twenty-fifth object of the invention is to provide an image fixing device which is capable of detecting the surface temperature of the rotor even if an induction heating mechanism is small in order to reduce costs.

To attain the aforementioned first object, there is provided an image fixing device for fixing an image by applying heat to a recording material having an unfixed image impregnated therein, the device having a first rotor arranged in a pressed state, a second rotor and an induction coil either inside of the aforementioned second rotor or inside of the aforementioned first rotor or both the aforementioned first rotor and the aforementioned second rotor whereby an induction current is generated in the heating part with a high frequency current which is allowed to pass therethrough to generate heat; the device comprising:

at least one of temperature detection means for detecting temperature of the rotor which has an induction coil inside to control the high frequency current which is allowed to pass through the aforementioned induction coil; or temperature over-rise preventing detection means for detecting that the temperature of the aforementioned rotor has risen to a predetermined temperature to prevent the temperature of the aforementioned rotor from rising to a high level.

As a consequence, the response of the temperature detection becomes favorable and no damage is made to the separation layer even if the separation layer is provided on the surface of the rotor. Furthermore, no stain of the toner or paper dust is stuck to the temperature detection part so that there is no need of cleaning the device at the time of the maintenance and the endurance of either of the rotor, the temperature detection means and the temperature over-rise detecting means is improved.

To attain the aforementioned first object, there is provided an image forming apparatus comprising the aforementioned image fixing device wherein a response of the temperature detection becomes favorable, no damage is done to the separation layer even if the separation layer is provided, no stain of the toner or paper dust is stuck to the temperature detection part so that there is no need of cleaning the temperature detection part, and the endurance of at least one of the rotor, the temperature detection means, and the temperature over-rise preventing detection means is improved.

To attain the aforementioned first object, there is provided a rotor which is used in the image fixing device for fixing the image by applying heat to a recording material having an unfixed toner image impregnated therein, in which an induction coil is provided inside, and an induction current is generated in a heating part of the aforementioned rotor with a high frequency current which is allowed to pass through the induction coil to generate heat, the rotor comprising inside thereof:

at least temperature detection means for detecting the temperature for controlling a high frequency current which is allowed to pass through the aforementioned induction coil: or temperature over-rise preventing detection means for detecting that the temperature of the rotor has risen to a predetermined temperature for preventing the temperature of the rotor from rising to an unusually high level.

As a consequence, the response of the temperature detection becomes favorable and no damage is done to the separation layer even if the separation layer is provided on the surface of the rotor. No stain of the toner or paper dust is stuck to the temperature detecting part so that there is no need of cleaning the temperature detecing part at the time of maintenance and the endurance of at least one of the rotor, the temperature detection means and the temperature over-rise preventing detection means is improved.

To attain the aforementioned second object, there is provided an image fixing device for fixing an image by applying heat to a recording material having an unfixed toner image impregnated therein, the device having a first rotor arranged in a pressed state, a second rotor and an induction coil either inside of the aforementioned second rotor or inside of the aforementioned first rotor or both the aforementioned first rotor and the aforementioned second rotor whereby an induction current is generated in the heating part with a high frequency current which is allowed to pass therethrough to generate heat; the device comprising:

temperature detection means for detecting the temperature of a rotor having an induction coil inside to control a high frequency current which is allowed to pass through the aforementioned induction coil; and a correction means for correcting while a high frequency current is output which is allowed to pass through the aforementioned induction coil with respect to the aforementioned temperature detection means;

wherein the magnetic flux which is generated at the time of induction heating does not affect the temperature detection means, and the temperature detection accuracy is improved.

To attain the aforementioned second object, there is provided an image forming apparatus which provides an image fixing device wherein the magnetic flux which is generated at the time of induction heating does not affect the temperature detection means, and the temperature detection accuracy is improved.

To attain the aforementioned second object, there is provided a rotor which is used in the image fixing device for fixing the image by applying heat to the recording material having an unfixed toner image impregnated therein, in which an induction coil is provided inside, and an induction current is generated in a heating part of the aforementioned rotor with a high frequency current which is allowed to pass through the induction coil to generate heat, the rotor comprising:

temperature detection means for detecting the temperature of the aforementioned rotor to control a high frequency current which is allowed to pass through the aforementioned induction coil; and a correction means for correcting while a high frequency current is output which is allowed to pass through the aforementioned induction coil with respect to the aforementioned temperature detection means;

wherein the magnetic flux which is generated at the time of induction heating does not affect the temperature detection means, and the temperature detection accuracy is improved.

To attain the aforementioned third object, there is provided an image fixing device for fixing an image by applying heat to the recording medium having an unfixed toner image impregnated therein, the device having a first rotor arranged in a pressed state, a second rotor and an induction coil either inside of the aforementioned second rotor or inside of the aforementioned first rotor or both the aforementioned first rotor and the aforementioned second rotor whereby an induction current is generated in the heating part with a high frequency current which is allowed to pass therethrough to generate heat; the device comprising:

temperature over-rise preventing detection means for detecting that the temperature of the aforementioned rotor has attained a predetermined level to prevent the temperature of the rotor having an induction coil inside from rising to an unusually high level; and a member formed of a magnetic material arranged in the vicinity of the temperature over-rise preventing detection means;

wherein the response of the temperature over-rise preventing means is improved.

To attain the aforementioned fourth object, there is provided an image fixing device for fixing an image by applying heat to the recording material having an unfixed toner image impregnated therein, the device having a first rotor arranged in a pressed state, a second rotor and an induction coil either inside of the aforementioned second rotor or inside of the aforementioned first rotor or both the aforementioned first rotor and the aforementioned second rotor whereby an induction current is generated in the heating part with a high frequency current which is allowed to pass therethrough to generate heat; the device comprising:

temperature detection means for detecting a surface temperature of the rotor having an induction coil inside;

temperature control means for controlling a high frequency current which is allowed to pass through the aforementioned coil on the basis of a detection value of the aforementioned temperature detection means;

wherein the aforementioned temperature detection means is arranged in correspondence to a position outside of the scope of the aforementioned coil in the axial direction of the aforementioned rotor, and the temperature detection means is alienated as much as possible from the influence scope of the electromagnetic induction heating mechanism to reduce the influence as much as possible thereby accurately detecting the temperature.

To attain the aforementioned fourth object of the invention, there is provided an image forming apparatus wherein the image fixing device is provided so that the temperature can be accurately detected.

To attain the aforementioned fourth object of the invention, there is provided a rotor which is used in an image fixing device for fixing an image by applying heat to a recording material having an unfixed image impregnated therein, the rotor having an induction coil inside which generates an induction current in the heating part of the aforementioned rotor with a high frequency current which is allowed to pass through the induction coil, the rotor comprising:

temperature detection means for detecting a surface temperature off the rotor; and temperature control means for controlling a high frequency current which is allowed to pass through the aforementioned induction coil on the basis of the detection value of the aforementioned detection means;

wherein the temperature detection means is arranged in correspondence to a position outside of the scope of the aforementioned induction coil in an axial direction of the aforementioned rotor, the temperature detection means is alienated as much as possible from the influence scope of the electromagnetic induction heating mechanism to minimize the influence so that the temperature can be detected accurately.

To attain the aforementioned fifth object of the invention, there is provided an image fixing device for fixing an image by applying heat to the recording material having an unfixed toner image impregnated therein, the device having a first rotor arranged in a pressed state, a second rotor and an induction coil either inside of the aforementioned second rotor or inside of the aforementioned first rotor or both the aforementioned first rotor and the aforementioned second rotor whereby an induction current is generated in the heating part with a high frequency current which is allowed to pass therethrough to generate heat; the device comprising:

temperature detection means for detecting a surface temperature of the rotor having the aforementioned induction coil inside; and temperature control means for controlling a high frequency current which is allowed to pass through the aforementioned induction coil on the basis of the detection value of the aforementioned temperature detection means;

wherein the aforementioned temperature detection means is covered with a magnetic shield material except for the detection part with respect to the aforementioned rotor, and the periphery of the temperature detection means is shielded from the magnetic field to minimize the influence of the electromagnetic induction heating mechanism thereby accurately detecting the temperature.

To attain the aforementioned fifth object of the invention, there is provided an image forming apparatus wherein the image fixing device described above is provided thereby accurately detecting the temperature.

To attain the aforementioned fifth object of the invention, there is provided a rotor which is used in an image fixing device for fixing the image by applying heat to the recording material having an unfixed toner image impregnated therein, the rotor having an induction coil inside which generates an induction current in the heating part of the aforementioned rotor with a high frequency current which is allowed to pass through the induction coil, the rotor comprising:

temperature detection means for detecting a surface temperature of the aforementioned rotor; and temperature control means for controlling a high frequency current which is allowed to pass through the aforementioned induction coil on the basis of the detection value of aforementioned temperature detection means;

wherein the aforementioned temperature detection means is covered with a magnetic shield material except for the detection part with respect to the aforementioned rotor, and the periphery of the temperature detection means is shielded from the magnetic field to minimize the influence of the electromagnetic induction heating mechanism thereby accurately detecting the temperature.

To attain the aforementioned fifth object of the invention, there is provided an image fixing device wherein the magnetic shield material is formed of engineering plastics having a temperature endurance of 80° C. or more.

To attain the fourth object of the invention, there is provided an image fixing device for fixing an image by applying heat to a recording material having an unfixed image impregnated therein, the device having a first rotor arranged in a pressed state, a second rotor and an induction coil either inside of the aforementioned second rotor or inside of the aforementioned first rotor or both the aforementioned first rotor and the aforementioned second rotor whereby an induction current is generated in the heating part with a high frequency current which is allowed to pass therethrough to generate heat; the device comprising:

temperature detection means for detecting a surface temperature of the rotor having the aforementioned induction coil therein; and temperature control means for controlling a high frequency current which is allowed to pass through the induction coil on the basis of the detection value of the aforementioned temperature detection means;

wherein the electromagnetic induction heating mechanism including the aforementioned coil is deflected from the shaft of the aforementioned rotor and is alienated from the aforementioned detection means, and the temperature detection means is alienated from the influence scope of the electromagnetic induction heating mechanism to minimize the influence thereby accurately detecting the temperature.

To attain the aforementioned sixth object of the invention, there is provided a rotor and an image fixing device for fixing an image by applying heat to a recording material having an unfixed toner image impregnated therein, the device having a first rotor arranged in a pressed state, a second rotor and an induction coil either inside of the aforementioned second rotor or inside of the aforementioned first rotor or both the aforementioned first rotor and the aforementioned second rotor whereby an induction current is generated in the heating part with a high frequency current which is allowed to pass therethrough to generate heat; the device comprising:

a rotor having an induction coil therein, the rotor comprising three layers, a non-magnetic heat resisting support layer, a thin magnetic heating layer and a separation layer, the three layers being constituted integrally, the three layers being detachable from a flange supporting the aforementioned three layers from both ends thereof, the rotor having a good efficiency and being suitable to a heat roller pair so as to be easily replaceable.

To attain the aforementioned seventh object of the invention, there is provided a rotor wherein a non-magnetic heat resisting support fixing part which is fixed to a flange is provided further on the aforementioned non-magnetic heat resisting support layer and the outside can be detached from the aforementioned non-magnetic support fixing part at the time of detaching the aforementioned non-magnetic support fixing part, the rotor being efficient and suitable to the heat roller pair.

To attain the aforementioned eighth object of the invention, there is provided a rotor wherein the thermal expansion ratio of the aforementioned non-conductive heat resisting support layer and the non-magnetic heat resisting support fixing layer is constituted so that the thermal expansion ratio of the aforementioned non-magnetic heat resisting support layer is larger than the thermal expansion ratio of the non-magnetic heat resisting support layer, and the support method can be simplified in addition to the aforementioned seventh object.

To attain the ninth object of the invention, there is provided a rotor wherein the aforementioned non-conductive heat resisting support layer is constituted so that the heat resisting exceeds the temperature load at the time of forming the aforementioned separation layer whereby the yield ratio is improved and the rotor can be produced stably at the time of mass production.

To attain the tenth object of the invention, there is provided a rotor wherein the aforementioned non-conductive heat resisting heat resisting support layer is formed of heat resisting resin, and the weight thereof is alleviated and the handling property is improved in addition to the aforementioned ninth object.

To attain the eleventh object of the invention, there is provided a rotor wherein the non-conductive heat resisting support layer is formed of polyimide resin, polybenzoimidazole resin or the like and the rotor is damaged at the time of over-heating of the rotor due to the trouble of the temperature control mechanism or the like of the image fixing device and an accident can be prevented in which the rotor pair which is pressed at a high pressure is scattered.

To attain the twelfth object of the invention, there is provided an image fixing device for fixing an image by applying heat to a recording material having an unfixed toner image impregnated therein, the device having a first rotor arranged in a pressed state, a second rotor and an induction coil either inside of the aforementioned second rotor or inside of the aforementioned first rotor or both the aforementioned first rotor and the aforementioned second rotor whereby an induction current is generated in the heating part with a high frequency current which is allowed to pass therethrough to generate heat; the device comprising:

a rotor having an induction coil inside;

a non-conductive cylindrical member formed of the aforementioned the heat resisting non-magnetic material;

a core part which is arranged inside of the aforementioned cylindrical member to generate an induction magnetic flux;

a magnetic and thin hollow cylinder which is loosely fit onto an external circumference of the aforementioned cylindrical member;

engaging means for engaging the aforementioned hollow cylinder to the aforementioned cylindrical member to allow the aforementioned cylinder to integrally rotate with the aforementioned cylindrical member.

A so-called rise time for realizing a desired fixing temperature on the surface of the aforementioned rotor, and the aforementioned rotor can be replaced fast, easily and at a low cost.

To attain the aforementioned twelfth object, there is provided an image fixing device wherein the aforementioned hollow ring of the rotor having an induction coil therein inside has an internal diameter which is larger than the external diameter of the aforementioned cylindrical member and the hollow ring is movably fit into the cylindrical member.

To attain the aforementioned twelfth object of the invention, there is provided an image fixing device wherein the aforementioned engaging means is composed of a perforation formed at an longitudinal direction end part of the aforementioned hollow cylinder and a group of engaging projections which is formed in the longitudinal direction end part of the aforementioned cylindrical member to be engaged with the aforementioned perforation.

To attain the aforementioned twelfth object, there is provided an image fixing device wherein the aforementioned cylindrical member is formed with a heat resisting elastic layer formed on an external circumference of the cylindrical body formed of the heat resisting resin, and the aforementioned engaging means is friction connected with the external circumference surface of the aforementioned heat resisting thermal elastic layer and the internal circumference surface of the aforementioned hollow cylinder.

To attain the aforementioned twelfth object, there is provided an image fixing device wherein the aforementioned heat resisting elastic layer in the aforementioned cylindrical member is formed of a foaming body, and an image fixing device wherein the volume of the foaming body is variable so that the heat resisting elastic layer can be slidably and loosely fit to the external circumference of the heat resisting body with the elastic property of the foaming body even in the case where the external diameter of the heat resisting elastic layer is larger than the internal diameter of the hollow cylinder.

To attain the twelfth object of the invention, there is provided an image fixing device wherein a separation layer is formed on an external circumference of the aforementioned hollow cylinder of the rotor having the induction coil inside so that the sticking of the toner image can be efficiently reduced.

To attain the twelfth object of the invention, there is provided an image fixing device wherein current can be supplied to an induction coil through the inside of the shaft of the core member.

To attain the thirteenth object of the invention, there Is provided an image fixing device for fixing an image by applying heat to a recording material having a toner image impregnated therein, the device having a first rotor arranged in a pressed state, a second rotor and an induction coil either inside of the aforementioned second rotor or inside of the aforementioned first rotor or both the aforementioned first rotor and the aforementioned second rotor whereby an induction current is generated in the heating part with a high frequency current which is allowed to pass therethrough to generate heat; the device comprising:

a rotor having an induction coil therein;

wherein the support part of the aforementioned shaft is formed of a non-magnetic body; and a rotor having an induction coil therein wherein a uniform state of the temperature distribution in the axial direction can be obtained, the rotor being capable of being produced favorably in large amounts.

To attain the thirteenth object of the invention, there is provided an image forming apparatus providing an image fixing device and a rotor having an induction coil therein wherein a uniform state of the temperature distribution can be obtained and mass production thereof is favorable.

To attain the aforementioned thirteenth object of the invention, there is provided a rotor which is used in an image fixing device for fixing an image by applying heat to a recording material having an unfixed toner image impregnated therein, the rotor having an induction coil inside which generates an induction current in the heating part of the aforementioned rotor with a high frequency current which is allowed to pass through the induction coil, the rotor comprising:

a core formed of a magnetic body fixed to a shaft for supporting the aforementioned rotor, the core having a coil wound thereon;

wherein the support part of the aforemetioned shaft is formed of a non-magnetic body and the uniformity of temperature in the axial direction can be obtained and the mass production thereof is favorable.

To attain the fourteenth object of the invention, there is provided a rotor which is used in an image fixing device for fixing a toner image by applying heat to a recording material having an unfixed impregnated therein, the rotor having an induction coil inside which generates an induction current in the heating part of the aforementioned rotor with a high frequency current which is allowed to pass through the induction coil, the rotor comprising:

an substrate layer and an external layer;

wherein the aforementioned external layer has a magnetic property, and the rise property of the surface temperature can be improved even when a material having a low thermal conduction property is low.

To attain the fifteenth object of the invention, there is provided a rotor used in an image fixing device for fixing an image by applying heat to a recording material having an unfixed toner image impregnated therein, the rotor having an induction coil inside which generates an induction current in the heating part of the aforementioned rotor with a high frequency current which is allowed to pass through the induction coil, the rotor comprising:

a substrate layer, an intermediate layer and a separation layer;

wherein the aforementioned intermediate layer has a magnetic property and the separation property is not lowered even when the heat conduction of rubber or the like is improved.

To attain the aforementioned fourteenth and fifteenth objects, there is provided a rotor used in an image fixing device for fixing an image by applying heat to a recording material having an unfixed toner image impregnated therein, the rotor having an induction coil inside which generates an induction current in the heating part of the aforementioned rotor with a high frequency current which is allowed to pass through the induction coil, the rotor comprising:

a substrate layer, an intermediate layer and a separation layer;

wherein the aforementioned separation layer has a magnetic property and the rise property of the surface temperature can be improved.

To attain the aforementioned objects 14 and 15, there is provided a rotor wherein the aforementioned separation layer has a magnetic property and the rise property of the surface temperature can be improved and the separation property is not lowered.

To attain the aforementioned fourteenth and fifteenth objects of the invention, there is provided a rotor wherein the rise property of the surface temperature can be improved and the separation property is not lowered.

To attain the aforementioned fourteenth and fifteenth objects of the invention, there is provided an image fixing device for fixing an image by applying heat to a recording material having an unfixed toner image therein, the device having a first rotor arranged in a pressed state, a second rotor and an induction coil either inside of the aforementioned second rotor or inside of the aforementioned first rotor or both the aforementioned first rotor and the aforementioned second rotor whereby an induction current is generated in the heating part with a high frequency current which is allowed to pass therethrough to generate heat; the device comprising:

said rotor having an induction coil inside which rotor is the rotor;

wherein the rise property of the surface temperature can be improved and the separation property is not lowered.

To attain the aforementioned fifteenth object of the invention, there is provided a rotor used in an image forming device for fixing an image by applying heat to a recording material having an unfixed image therein, the rotor having an induction coil inside which generates an induction current in the heating part of the aforementioned rotor with a high frequency current which is allowed to pass through the induction coil, the rotor comprising:

a substrate layer formed of a non-conductive heat resisting rigid material, a heat resisting elastic layer provided on an external circumference part of the aforementioned substrate, and a separation layer which are formed in this order;

a heating part formed by densely winding a thin linear magnetic body in a spiral configuration;

wherein a winding diameter of the aforementioned linear increases in a direction proceeding from the longitudinal central part of the aforementioned substrate layer to both end parts and the aforementioned linear magnetic body is located nearer to the aforementioned substrate layer at the aforementioned end parts thereof.

To attain the aforementioned sixteenth object of the invention, there is provided an image fixing device for fixing an image by applying heat to a recording material having an unfixed toner image impregnated therein, the device having a first rotor arranged in a pressed state, a second rotor and an induction coil either inside of the aforementioned second rotor or inside of the aforementioned first rotor or both the aforementioned first rotor and the aforementioned second rotor whereby an induction current is generated in the heating part with a high frequency current which is allowed to pass therethrough to generate heat; the device comprising:

the rotor having an induction coil inside being the rotor;

the other rotor being a rotor providing an elastic body with a magnetic property;

wherein a temperature gradient between the rotors can be reduced.

To attain the aforementioned seventeenth object of the invention, there is provided an image fixing device for fixing an image by applying heat to a recording material having an unfixed toner image therein, the device having a first rotor arranged in a pressed state, a second rotor and an induction coil either inside of the aforementioned second rotor or inside of the aforementioned first rotor or both the aforementioned first rotor and the aforementioned second rotor whereby an induction current is generated in the heating part with a high frequency current which is allowed to pass therethrough to generate heat; the device comprising:

the rotor having the induction coil having an induction heating mechanism including the aforementioned induction coil;

wherein the aforementioned heating mechanism comprises at least two or more independent heating mechanism which is arranged in an axial direction and allows electricity to pass independently and the recording material feeding stability is improved.

To attain the seventeenth object of the invention, there is provided an image forming apparatus providing the image fixing device according to claim 41, wherein the recording material feeding stability is improved.

To attain the seventeenth object of the invention, there is provided a rotor used in the image fixing device for fixing an image, the rotor having an induction coil inside which generates an induction current in the heating part of the aforementioned rotor with a high frequency current which is allowed to pass through the induction coil, the rotor having:

an induction heating mechanism including the aforementioned induction coil;

wherein the aforementioned induction heating mechanism comprises at least two independent induction heating mechanism which is arranged in an axial direction of the aforementioned rotor and allows electricity to pass independently and the recording material feeding stability is improved.

To attain the aforementioned eighteenth object of the invention, there is provided an image fixing device providing means for changing a conducted amount of electricity which is allowed to pass through the aforementioned two or more induction heating mechanism, wherein the heating distribution and an uneven configuration having an induction coil therein can be arbitrarily changed.

To attain the aforementioned nineteenth object of the invention, there is provided an image fixing device comprising recording material size detection means for detecting a size of the recording material tp which a toner image is fixed, and means for allowing only an induction heating mechanism corresponding to a size of the recording material detected by the recording material detection means to allow electricity to pass out of the aforementioned two or more two independent induction heating mechanism, wherein a part out of the size of the recording material of the rotor having an induction coil inside does not generate heat and energy can be saved.

To attain the aforementioned twentieth object of the invention, there is provided an image fixing device comprising a recording material size detection means for detecting a size of the recording material to which a toner image is fixed, and means for changing a difference in the passage amount of electricity between the induction heating mechanism of the both ends in the widthwise direction and the induction heating mechanism of the central part in the widthwise direction out of the aforementioned two or more independent corresponding to the detection by the aforementioned means and the thickness of the designated recording material and the passage amount of electricity of the aforementioned two independent induction heating mechanism so that the two or more independent induction heating mechanism generates the heat amount which is suitable to the aforementioned recording material, the device comprising:

a rotor having an induction coil inside, the rotor being capable of most suitably swelling to improve the recording material feeding stability and save energy.

To attain the aforementioned twenty-first object of the invention, there is provided an image fixing device comprising detection means for detecting the moisture or the moisture content of the recording material to which the toner image is fixed, and means for changing a difference in the passage amount of electricity between the induction heating mechanism of the both ends in the widthwise direction and the induction heating mechanism of the central part in the widthwise direction out of the aforementioned two or more independent corresponding to the detection result of the aforementioned detection means, the device comprising:

a rotor having an induction coil inside, the rotor swelling to the most appropriate amount suitable to the condition of the recording material to improve the recording material feeding stability and save energy.

To attain the aforementioned twenty-second object of the invention, there is provided an image fixing device which is used in an image forming apparatus for forming a toner image by reading a manuscript image, the device comprising:

manuscript blank part detection means for detecting a blank part of the aforementioned manuscript;

means for turning on and off the passage of electricity of the aforementioned two or more independent induction heating mechanism corresponding to the blank part of the manuscript detected by the aforementioned manuscript blank part detection means;

wherein a rotor having an induction coil swells depending on a part on the recording material where a toner image exists so that energy can be saved.

To attain the aforementioned twenty-third object of the invention, there is provided an image fixing device comprising at least one temperature detection means for detecting a surface temperature of the aforementioned rotor arranged corresponding to the aforementioned two independent induction heating mechanism;

wherein a surface temperature of the rotor having an induction coil can be controlled independently for each part which is induced and heated with each induction heating mechanism.

To attain the aforementioned twenty-fourth object of the invention, there is provided an image fixing device comprising a temperature fuse for detecting the surface temperature of the aforementioned rotor in all the areas of the aforementioned two or more independent induction heating mechanism, wherein a safety mechanism can be functioned with the temperature fuse when any of the two or more independent induction heating mechanism runs away.

To attain the twenty-fifth object of the invention, there is provided an image fixing device comprising temperature detection means for sequentially detecting a surface temperature of the aforementioned rotor which is rotatably provided corresponding to the aforementioned two or more independent induction heating mechanism, wherein the surface temperature can be detected even when the induction heating mechanism is small and the cost thereof can be decreased.

DESCRIPTION OF THE PREFERRED EMBODIMENTS

Figure 1:
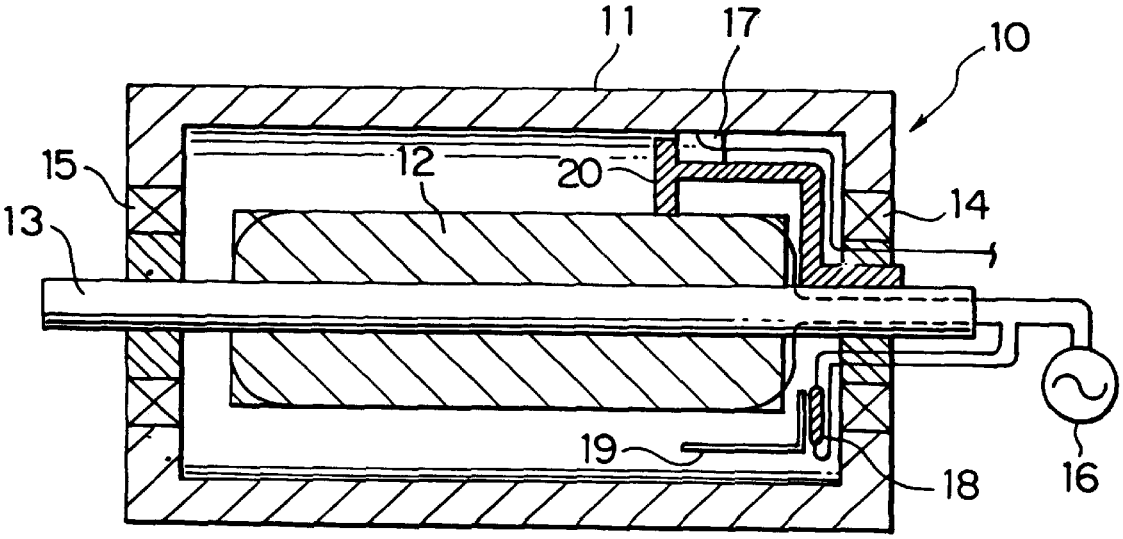
FIG. 1 is a sectional view showing one rotor having an induction coil therein, the rotor being used in an image fixing device according to one embodiment of the invention.

FIG. 1 shows one rotor having an induction coil therein, the rotor being used in an image fixing device according to one embodiment of the invention. This embodiment is one form of a heat image fixing device used in the image fixing device such as a printer, a facsimile machine or the like. Inside of the heat image fixing device, a rotor 10 having an induction coil therein, a heating part 11, and an induction part 12 are provided. The induction part 12 includes a core fixed to a main shaft and a winding wound around the main shaft 13.

The heating part 11 comprises a conductive roller, and is rotatably supported on the main shaft 13 with bearings 14 and 15. The winding of the induction part 12 is connected to a power source 16 and is driven with an alternating current from the power source 16 to generate an alternating magnetic flux. The heating part 11 allows an induction current to flow with the alternating magnetic flux from the induction part 12 to generate joule heat. That is, the heating part 11 is induced and heated to generate heat.

Figure 2:
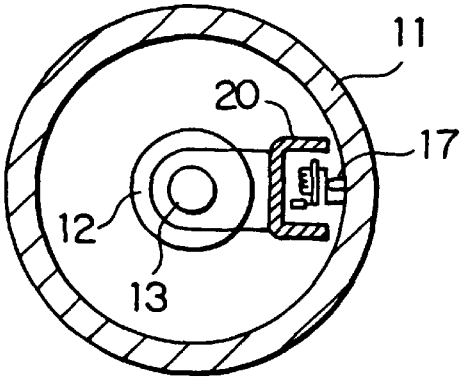
FIG. 2 is a sectional view showing part of a rotor having an induction coil inside which is used in the image fixing device according to claims 1 and 8.

A temperature detection part 17 uses a thermistor, for example, as shown in FIG. 2 and is provided in contact with an internal circumference of a conductive roller 11 to detect the temperature of the conductive roller 11. A controller as a control means not shown controls the power source 16 on the basis of a temperature detection signal from the temperature detection means 17 and controls a supply power to the winding of the induction part 12 so that the temperature of the heating part 11 is set to a definite temperature.

A surface layer of the heating part 11 is composed of a separation layer. This separation layer is covered with heat resisting resin such as tetrafluoroethylene or the like so that the surface is less liable to be damaged. The thermistor is provided inside of the heating part 11 so that the separation layer on the surface of the heating part 11 is not damaged with the thermistor 17 and the endurance of the heating part 11 is improved with the result that stains of the toner and paper dust is removed and the temperature can be detected stably at any time.

Furthermore, a temperature fuse 18 as a temperature over-rise preventing detection means for a rise of the temperature of the conductive roller 11 to a predetermined temperature is connected between the winding of the induction part 12 and a power source 16. The temperature fuse 18 is provided inside of the heating part 11. The temperature fuse 18 detects the temperature of the conductive roller 11. Then when the temperature of the conductive roller 11 is less than the predetermined level, the conductive roller is set in a conductive state so that the winding of the induction part 12 and the power source 16 are connected. When the temperature of the conductive roller 16 exceeds the predetermined level, and the excess of the temperature over the predetermined level is detected, the shielded state is provided thereby preventing an unusual rise of the temperature of the conductive roller 11 by shielding a space between the winding of the induction part 12 and the power source 16.

The reason why the temperature over-rise preventing detection means 18 is provided inside of the heating part 11 is that the temperature over-rise preventing detection means 18 detects an atmospheric temperature so that a temperature fuse which is changed from the conductive state to the shielded state is used so that the atmospheric temperature can be easily detected by providing the temperature fuse inside of the heating part 11 so that the response is heightened. Furthermore, a conductive member 19 comprising a heated line is arranged in the vicinity of the temperature fuse 18 to heighten the response of the temperature fuse 18 and the conductive member 19 is heated with the induction heating by the induction part 12 to raise the temperature thereof prior to the conductive roller 11 with the result that the response of the temperature fuse 18 is heightened.

Since an image fixing device according to the embodiment having a conductive roller 11 which is rotatably supported, and an induction part 12 which is provided in this conductive roller and serves as an induction heating means further comprises a temperature fuse 18 as temperature over-rise preventing detection means which detects that the temperature of the conductive roller 11 has attained a predetermined level to prevent the temperature roller from rising to an unusually high level, and a member formed of a magnetic body which is arranged in the vicinity of the temperature over-rise detection means 18.

Figure 3:
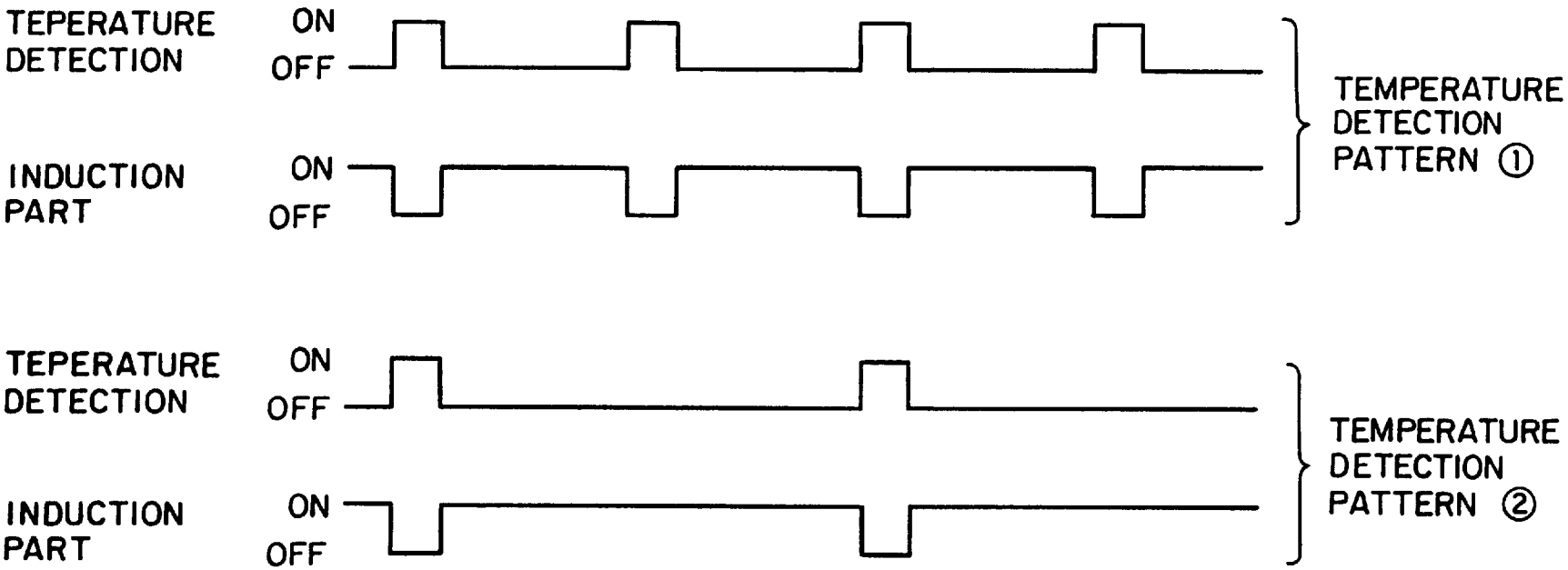
FIG. 3 is a timing chart showing an operation timing of one embodiment of the invention according to claim 4.
Figure 4:
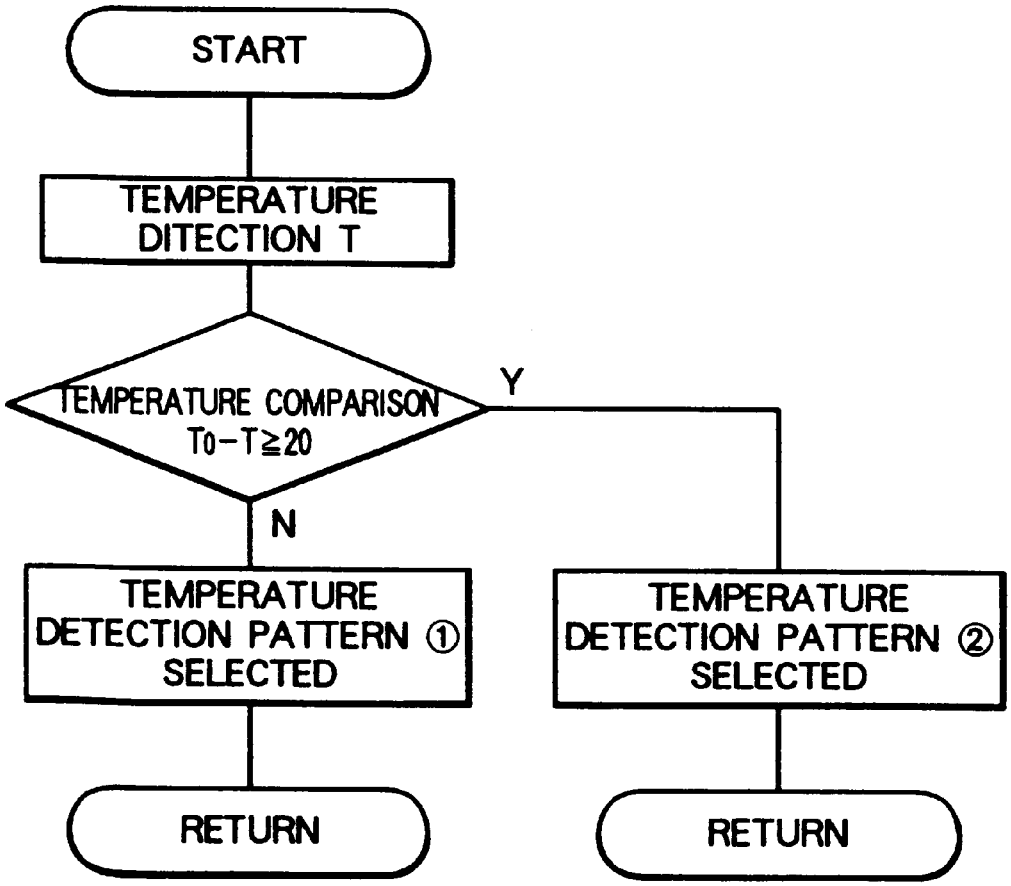
FIG. 4 is a flowchart showing a processing flow of a controller in one embodiment of the invention according to claim 4.

FIG. 3 shows an operation timing of one embodiment of the invention. FIG. 4 shows a processing flow of a controller in the embodiment. When a conductor such as a thermistor or the like is used as temperature detection means, the temperature detection means makes an error of detection of the conductive roller under the influence of the magnetic flux which is generated from the induction heating means. Thus, in the embodiment, the generation of the magnetic flux is stopped by ending power supply to the induction part 12 at the time of the temperature detection by the temperature detection means 17 in the embodiment of the invention to prevent a detection error under the influence of the magnetic flux from the temperature detection means.

In other words, the aforementioned detects in a definite cycle the temperature of the conductive roller 11 by sampling and incorporating a temperature detection signal from the temperature detection means 17 in a definite cycle and controls the power source 16 at the time of the temperature detection thereby ending power supply to the winding of the induction part 12 from the power source 16. On the other hand, at other times than the time of the temperature detection, the power source 16 is controlled to supply power to the winding of the induction part 12 from the power source 16 to allow the induction part 12 to induct and heat the conductive roller 12.

Furthermore, the controller detects the temperature T of the conductive roller 11 from the temperature detection signal which is sampled and incorporated from the temperature detection means 17 at the time of temperature detection by providing a plurality of patterns of power supply time to the induction time 12 and the temperature detection time. The pattern of the temperature detection time and the power supply time to the winding of the induction part 12 by changing a plurality of temperature detection patterns in accordance with the temperature T.

For example, the controller judges whether or not a difference (To−T) between the temperature T of the conductive roller 11 and the set temperature To of the conductive roller 11 is 20° C. or more. When the difference between the temperature T of the conductive roller 11 and the set temperature To of the conductive roller 11 is 20° C. or more, the controller judges the heating image fixing device is being warmed up and selects the temperature detection pattern ② by setting the aforementioned cycle as a long cycle. Furthermore, the controller judges that the heating image fixing device of this embodiment is set in a normal operation state after the warm-up if the temperature difference is not 20° C. or more. The temperature detection pattern ① selected by setting the aforementioned cycle as a short cycle. For example, the set temperature To is set to 185° C.

Here, the reason why a plurality of patterns of temperature detection and power supply time to the winding of the induction part 12 are provided is that when the sampling interval of the temperature detection time from the temperature detection means is short the power supply time to the induction part 12 is decreased by that sampling interval the time (warm-up time) until the temperature of the heating part 11 attains a predetermined level is long. In other words, in the case where the temperature T of the conductive roller 11 is lower than the set temperature To of the conductive roller 11 by a definite value (20° C.) in this embodiment, the temperature detection pattern ② is selected in which the power supply to the induction part 12 is long.

Since the image fixing device of the embodiment which has a conductive roller 11 which is rotatably supported, and an induction part 12 which is provided in this conductive roller and serves as an induction heating means further comprises a temperature detection means for detecting the temperature of the conductive roller 11 to control the induction heating means 12, and a controller as means for ending an output of induction heating means at the time of the temperature detection of the conductive roller 11, the magnetic flux which is generated at the time of induction heating does not affect the temperature detection means at the time of the detection of the conductive roller and the temperature detection accuracy can be improved.

Figure 5:
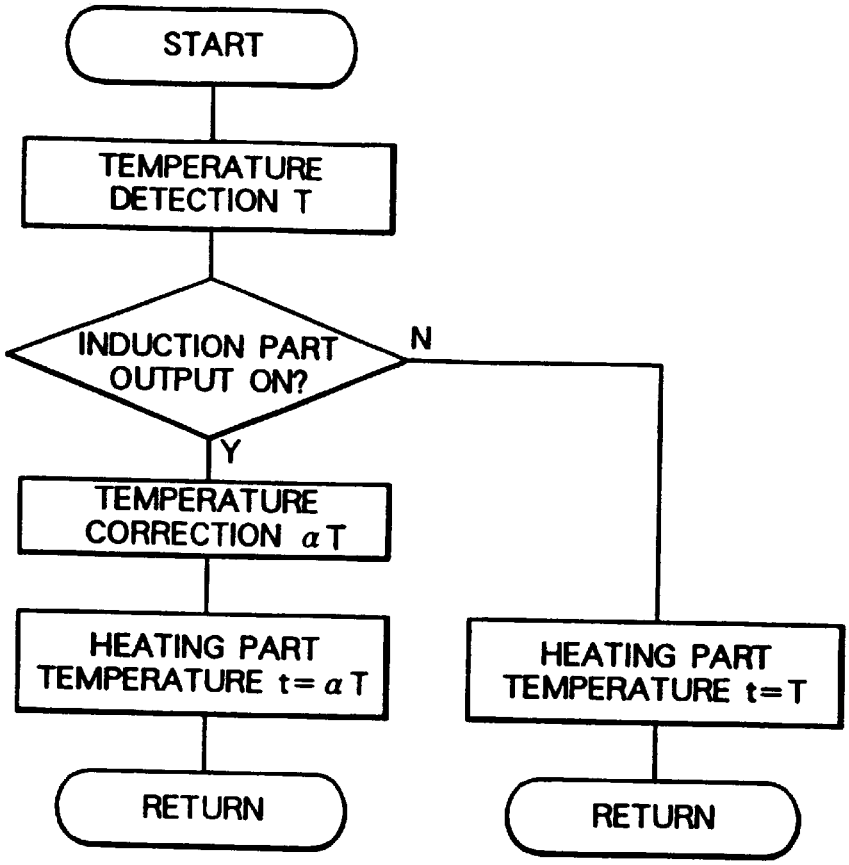
FIG. 5 is a flowchart showing a processing flow of the controller according to one embodiment of the invention according to claim 5.

FIG. 5 shows a processing flow of the controller in one embodiment of the invention. In this embodiment, since the output value of the temperature detection means 17 is affected at the time of the generation of the magnetic flux with a power supply to the induction part 12 from the power source 16 in the embodiment, the temperature is corrected.

The aforementioned controller detects the temperature of the conductive roller 11 by sampling and incorporating the temperature detection signal from the temperature detection means 17 in a predetermined cycle to judge whether or not the power is supplied to the induction part 12 from the power source 16 and the magnetic flux is generated. When the induction part 12 output is on from the power source 16, the temperature T of the conductive roller 11 is corrected to a temperature (actual temperature t of the conductive roller 11 when the temperature detection means 17 of the magnetic flux is not affected by the induction part 12) by multiplying a correction constant $\alpha$ to the temperature of the conductive roller 11 which is detected with the temperature detection signal from the temperature detection means 17. Then the controller controls the power source 16 on the basis of t thereby controlling the supply power to the winding of the induction part 12 from the power source 16 so that the temperature of the heating part 11 is set to a predetermined definite level.

In this embodiment, the temperature detection of the heating part 11 can be made possible in the supply power to the induction part 12 from the power source 16 as compared with one embodiment of the invention according to the wherein the supply power to the winding of the induction part 12 from the power source 16 with the result that the warm-up time can be shortened and the temperature of the heating part 11 can be controlled more finely.

Since the image fixing device of the embodiment which has a conductive roller 11 which is rotatably supported, and an induction part 12 which is provided in this conductive roller and serves as an induction heating means further comprises temperature detection means for detecting the temperature of the conductive roller 11 to control the induction heating means 12, and a controller as correction means for correction during an output of the induction heating means 12 with respect to the temperature detection signal of this temperature detection means 17, the magnetic flux generated at the time of the induction heating does not affect the temperature detection means so that the temperature detection precision can be improved and the temperature of the conductive roller 11 can be most suitably controlled.

Figure 6:
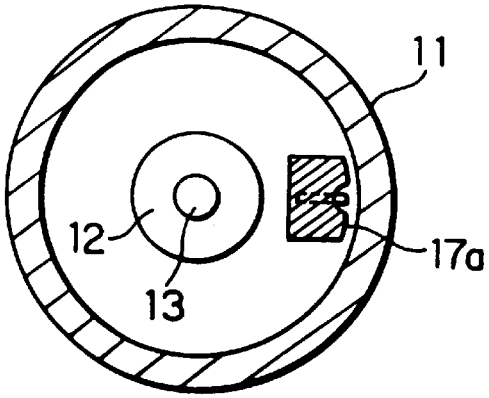
FIG. 6 is a sectional view showing another embodiment of the invention according to claims 1 through 8.

Incidentally, in the aforementioned embodiment, a contact type temperature detection means 17 which contacts the conductive roller 11 is used as the temperature detection means. As shown in FIG. 6, a non-contact type temperature detection means 17*a* may be used which is provided inside of the conductive roller 11 so as not to contact the conductive roller 11 to detect the temperature of the conductive roller 11. In such a structure, since no sliding part is provided between the conductive roller 11 and the temperature detection means 11, the durability of the temperature detection means is improved.

Figure 11:
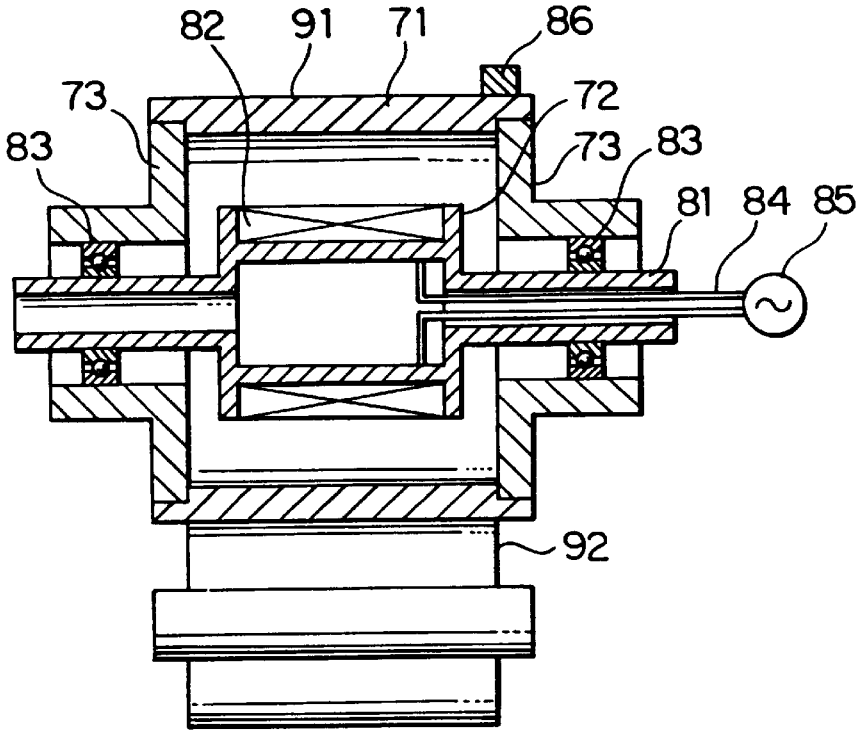
FIG. 11 is a schematic sectional view showing a structure example of the image fixing device using the rotor having the induction coil of the invention according to claims 17 through 22.
Figure 12:
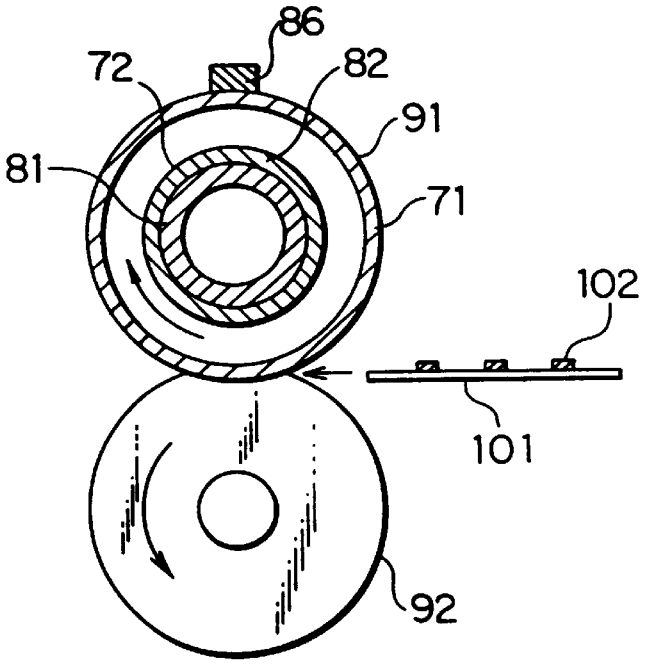
FIG. 12 is a sectional view showing a cross section of the image fixing device shown in FIG. 11, the cross section running at right angle with the shaft of the rotor.

FIG. 11 is a sectional view showing one structure example of the image fixing device using a rotor having an induction coil inside. Furthermore, FIG. 12 is a sectional view showing a cross section which runs at right angle with the shaft of the rotor in the image fixing device shown in FIG. 11. The rotor 91 having an induction coil inside comprises an external cylinder 71, an internal cylinder 72, and a rotatable flange 73. The internal cylinder 72 comprises an iron core 81 which is integrally formed with the shaft, and an induction coil 82 wound around the iron core 81 which constitutes a magnetic field generating means. The induction coil 82 is connected to an alternate current power source with a lead line 84. The external cylinder 71 which constitutes the heating part is concentrically arranged so as to surround the external periphery of the internal cylinder 72 and a flange 73 is arranged on both sides thereof and is connected with a screw not shown. This flange 73 is rotatably supported on the shaft of the iron core of the internal cylinder via a bearing 83. One flange is provided with a driving gear not shown and is connected to a motor not shown via the driving gear. Consequently, in the rotor 91 having an induction coil inside, the internal cylinder 72 is fixed and only the external cylinder is rotated.

As the rotor 92, a rotor is used wherein an elastic body formed of silicone rubber or the like is formed on the core. The rotor 92 is contacted with a rotor having an induction coil inside with a predetermined pressure to form a thermal rotor pair and a nip part. The unfixed toner image impregnated on the recording material is heated and molten by passing through the nip part, and is fixed onto the recording material 101. On the external surface of the rotor 91 having the induction coil inside the temperature detection means 86 such as a thermistor or the like is arranged so that the surface temperature of the rotor 91 having the induction coil inside is detected with the temperature detection means 86, and the surface temperature is controlled to a desired level by controlling the output current of the alternate power source 15 with control means not shown.

Here, inside of the rotor using the electromagnetic induction heating having the conventional structure, the external cylinder of the rotor having the induction coil inside is formed of a conductor such as metal or the like. When the induction coil of the internal cylinder is excited with the alternate current, the alternate overcurrent is generated in the internal wall of the external cylinder so that the vicinity of the internal wall generates heat with joule heat. The generated heat is conducted toward the outside of the radial direction so that the surface is heated. At this time, since the external cylinder with a thinner wall has smaller heat capacity, such an external cylinder has an advantage in that the rise time needed for the warming is decreased. However, the strength thereof is deteriorated with the thinner thickness of the wall, so that the external cylinder cannot endure pressure generated when the external cylinder is pressed against the pressing roller. As a consequence, the roller is deformed and there arise problems in the feeding of the recording material 101 and the fixing property of the toner 102. In addition, there is available a method for supporting the external cylinder of the thin layer with the elastic body. However, the method has the problem described above in the description of the related art.

Therefore, the invention is constituted so that the external cylinder 71 of the heating part of the rotor 91 having the induction coil inside is formed of three layers, a non-magnetic heat resisting support layer, a thin layer and a separation layer. In other words, by constituting the external cylinder of the fixing roller in three layers, it is possible to form an image fixing roller which is efficient and has a short rise time.

Concrete embodiments of the invention will be explained hereinbelow.

Figure 13:
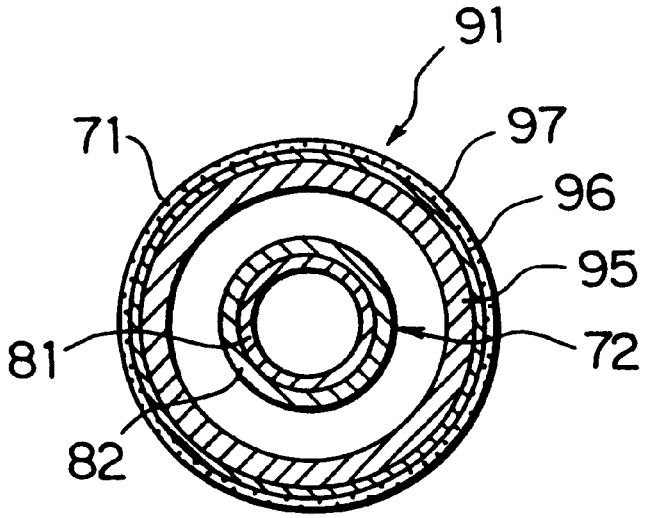
FIG. 13 is a sectional view showing one embodiment of the rotor having an induction coil inside according to claims 17 through 22.

FIG. 13 is a sectional view of the rotor having the induction coil inside. The external cylinder 71 of the rotor 91 having the induction coil inside comprises a non-magnetic heat resisting support layer 95, a magnetic heating layer 96 and a separation layer 97. The magnetic heating layer 96 is formed of a material having a magnetic property, such as a metal thin layer and material woven with a carbon fiber or the like. The material is formed thin so that the heat capacity is small. The magnetic heat resisting support layer 95 serves as means for supporting the magnetic heating layer which is inferior in strength so that the magnetic heating layer is not deformed. A non-conductive and non-magnetic material such as glass, resin, ceramic or the like is used. Furthermore, it is desirable that a material having a small heat capacity or a material having a small heat conduction rate is used and the rise time is not harmed. As the separation layer 97, a layer coated with a thin layer having a thickness of 10 to 30 $\mu$m or a material which is processed in a tube-like shape is used thereby preventing a disadvantage which is called offset wherein the molten toner sticks to the roller surface at the nip part and again sticks to the recording material. Next, as an embodiment, a material is selected and processed so that the aforementioned three layers 95, 96 and 97 which constitute the external cylinder of the rotor 91 having the induction coil inside can be integrated. Specifically, on the surface of the non-magnetic heat resisting support layer 95, a thin layer is formed of metal such as, for example, nickel, gold, and silver as the magnetic heating layer 96 by means of coating and vapor deposition method. Then the fine particle fluorine resin such as PFA, PTFE, FEP or the like coats the surface of the thin layer and sintered, or a thin layer is covered with a tube or is heat shrunken thereby forming the separation layer 97 or the like. With such a method, the three layer external cylinder 71 can be integrally formed, and the rotor having the induction coil inside can be integrally removed from the flange 73. Since there is no need of separating and removing each layer, the replacement at the time of the maintenance will be improved.

Figure 14:
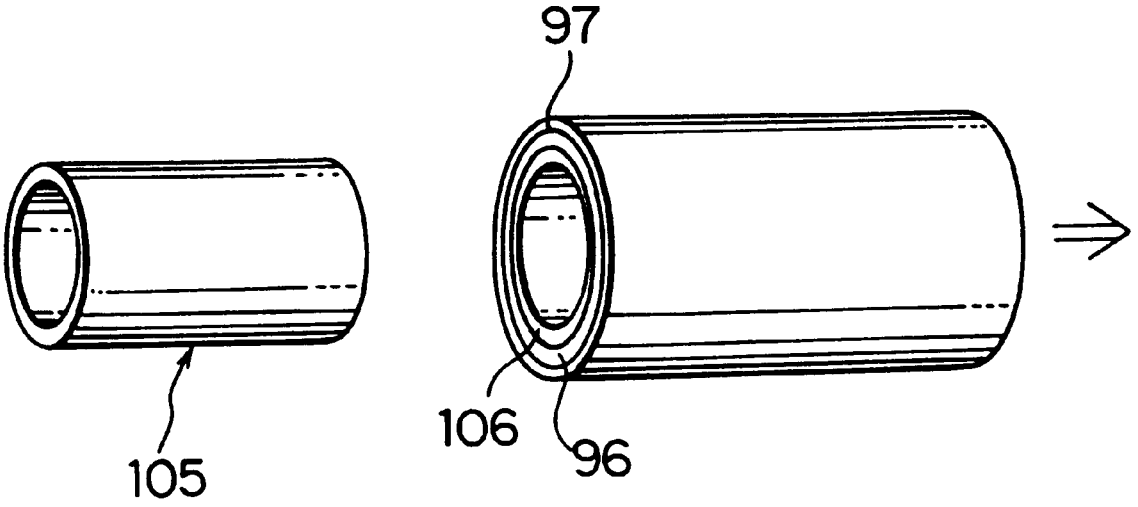
FIG. 14 is a perspective view showing a structure example of an external cylinder of the rotor having the induction coil inside according to claims 17 through 22.

Next, an embodiment is shown in FIG. 14. Here, the magnetic heat resisting support layer 95 is composed of a fixed part 105 and a movable part 106. Then the magnetic heat resisting support layer 95 is constituted so that the fixed part 105 is fixed to the flange 73 of the rotor 91 having the induction inside shown in FIG. 11 and the movable part 106 is set in the fixed part 105. With such a structure, when the there arises a need of replacing the rotor 91 having the induction coil inside because of the life of the separation layer 97 or the like, the part outside of the movable part can be integrally removed so that there is no need of removing the driving part and the internal cylinder so that the replacement property is improved.

Next, as an embodiment, in the rotor having the induction coil inside, the non-magnetic heat resisting support layer 95 is constituted so that the fixing part 105 and the movable part 106 are formed of material such that the heat expansion rate of the fixed part 105 is larger than the heat expansion rate of the movable part 106. For example, PPS (polyphenylsulfide) is used in the fixed part 105 and PI (polyimide) is used in the movable part 106 so that the non-magnetic heat resisting support layer naturally shrinks with a rise in temperature at the time of usage. Thus there arises an advantage that that there is no need of adopting a specific fixing method. Furthermore, as the material of the fixed part 105, a material having a lower heat resistance than the material of the movable part 106 can be selected. Consequently, there is an advantage in that the fixed part can be made at cheap cost. Furthermore, since the fixed part 105 can remain fixed to the flange 73, the position precision can be maintained even after the maintenance when the fixed part is attached with a high precision at the time of manufacturing the fixed part 105. As a result it is less likely that jitters resulting from an unfavorable position precision and an unfavorable feeding are generated.

Next, as one embodiment, in the rotor 91 having the induction coil inside, the non-magnetic heat resisting support layer 95 is set to a higher level than the sintered temperature of the fluorine resin which forms the separation layer 97 so that there is no case that the layer is heat deformed at the time of manufacturing the layer and the yield is not lowered.

Next, as one embodiment, in the rotor 91 having the induction coil inside, the non-magnetic heat resisting support layer 95 is formed of heat resisting resin. As a result, the weight of the external cylinder 71 is alleviated and the torque distortion is suppressed at the time of the start of the drive and the handling at the time of the maintenance can be improved.

Next, as one embodiment, in the rotor 91 having the induction coil inside, the non-magnetic heat resisting support layer 95 is formed of heat curing heat resisting resin such as PI (polyimide) resin or PBI (polybenzeimidazole) resin or the like. With such a structure, a very high strength can be maintained in a wide scope of temperature. Consequently, when the temperature of the rotor having the induction coil inside rises to an unusually high level because of the failure of the temperature control mechanism, there arises no case in that the roller is molten and damaged and no accident is generated.

Figure 7:
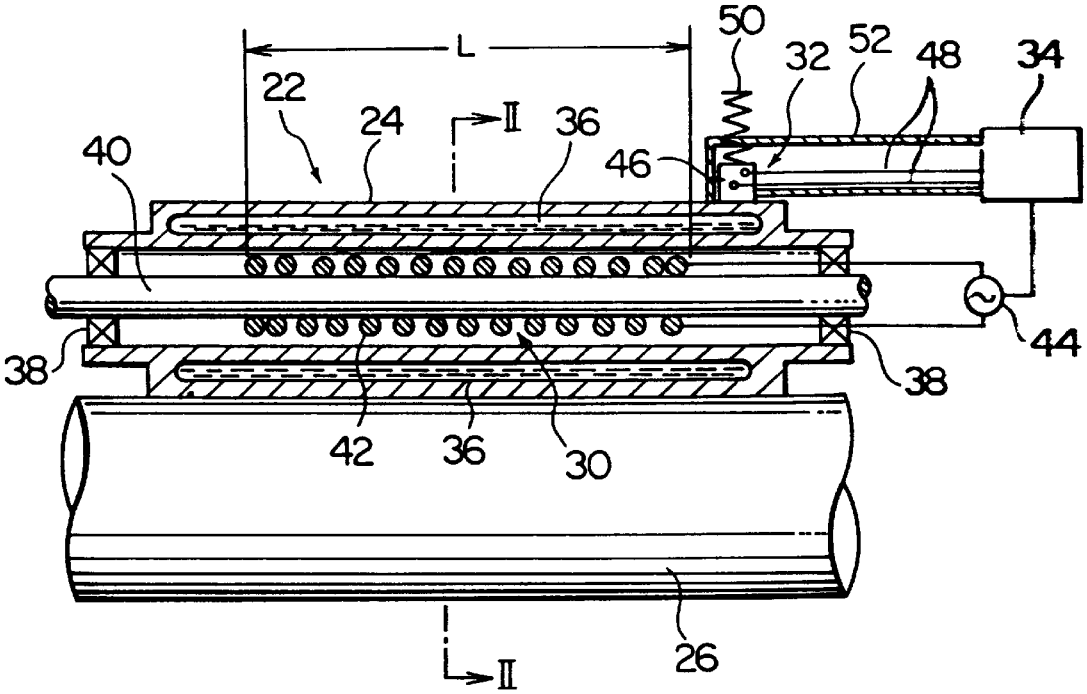
FIG. 7 is a schematic sectional view showing the image fixing device according to one embodiment of the invention according to claims 9 through 16.
Figure 8:
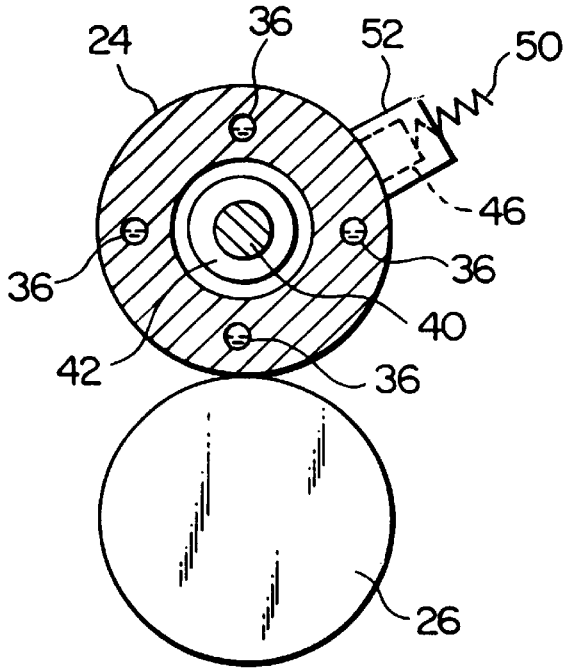
FIG. 8 is a schematic sectional view taken along line II—II of FIG. 7.

One embodiment of the invention will be explained on the basis of FIGS. 7 and 8.

The rotor 24 having the induction coil inside and the rotor 26 are located opposite to each other and are arranged in the image fixing device 22. For example, the rotor is constituted so that a recording material having a toner image transcribed is allowed to pass between rotors under a predetermined pressure.

The rotor 24 having the induction coil inside generally comprises a main body 28 of a hollow-shaped roller formed of a non-magnetic induction heating mechanism and an electromagnetic induction heating mechanism 30 provided inside of the main body of the roller. On one end side of the rotor 24 having the induction coil inside, the temperature detection means 32 is arranged for detecting the surface temperature of the main body 28 of the roller and this temperature detection means 32 is connected to the temperature control means 34.

Four jacket chambers having a shape suitable to a space which extends in an axial direction are formed at intervals in a circumferential direction, and two-phase thermal carrier in a liquid state and a gas state is sealed in this jacket chamber 36.

The electromagnetic induction heating mechanism 30 comprises a rod-like iron core 40 which is supported at the axial position of the main body 28 of the roller and an induction coil which is wound on the external surface of the iron core so as to extend in the axial direction. Then the induction coil 42 is connected to an alternate current power source 44 for exciting the induction coil 42. Furthermore, the alternate current power source 44 is connected to the aforementioned temperature control means 34 so that the power source 34 is controlled so that the power source 44 is turned on and off with the temperature control means 34.

The temperature detection means 32 comprises this temperature sensor 46 and a lead line 48 which connects the temperature sensor 46 and the temperature control means 34. The surface temperature of the main body 28 of the roller which is detected with the temperature sensor 46 is input to the temperature control means 34 as an electric signal. The temperature sensor 46 is constantly energized with a spring member 50 which serves as a pressed member having one end supported at an appropriate position of the main body of the sensor 46 and the sensor 46 is pressed against the surface of the main body 28 of the roller.

The temperature detection means (the temperature sensor 46) as one kind of an electric circuit is arranged in a scope where the influence of the magnetic field by the electromagnetic induction heating mechanism 30 is large, namely at a position alienated from the length scope L in the axial direction of the induction coil 42.

When the alternate current power source 44 is turned on in the aforementioned structure so that the induction coil 42 is excited, the magnetic flux which passes through the internal circumferential wall part of the main body 28 of the roller is generated so that the alternate current is induced along the circumferential direction with it, and main body of the roller generates joule heat. With the gaseficaction and condensation of the thermal carrier which is charged in the jacket chamber 36, the surface temperature distribution of the main body of the roller becomes uniform.

When the surface temperature of the main body of the roller 28 is shifted from the set temperature, the input of the alternate current power source is controlled with the temperature control means 34 on the basis of the detection value of the temperature detection means 32.

Since the temperature detection means 32 is arranged at a position which is deviated from the length scope L in the axial direction of the induction coil 42, the leaked magnetic flux intrudes into the circuit of the temperature detection means so that an eddy current is generated with the result that a disadvantage can be suppressed as much as possible such that the current property of the temperature sensor 46 is disordered and a noise is generated. Consequently, the surface temperature of the main body of the roller can be accurately detected with the temperature detection means 32 so that the set temperature control maintenance by means of the temperature control means becomes accurate. As a consequence, the temperature of the heating roller 4 is uniformed, and the quality of the image can be uniformed as well.

Since the temperature of the rotor 24 having the induction coil inside is uniform at any position with the advantage of the jacket chamber 36, the temperature detection means 32 may be located outside of the image if the temperature detection means corresponds to the scope of the jacket chamber 36.

Furthermore, in the temperature detection means 32, a part excluding the detection part of the temperature sensor 46 and 26 with respect to the main body 28 of the roller is covered with the magnetic shield member 52. With such a structure, the intrusion of the leaked magnetic flux is shielded and the precision of the temperature control can be further heightened along with the arrangement structure which is alienated from the scope where the influence of the magnetic field is large.

As the magnetic shield member 52, an engineering plastic (non-conductive and non-magnetic) having a heat resistance of 80° C. is used. The engineering plastic can be selected from PI (polyimide), PA (polyamide), PAI (polyamideimide), PPS (polyphenylenesulfide) and PET (polyethyleneterephthalate) or the like.

Figure 9:
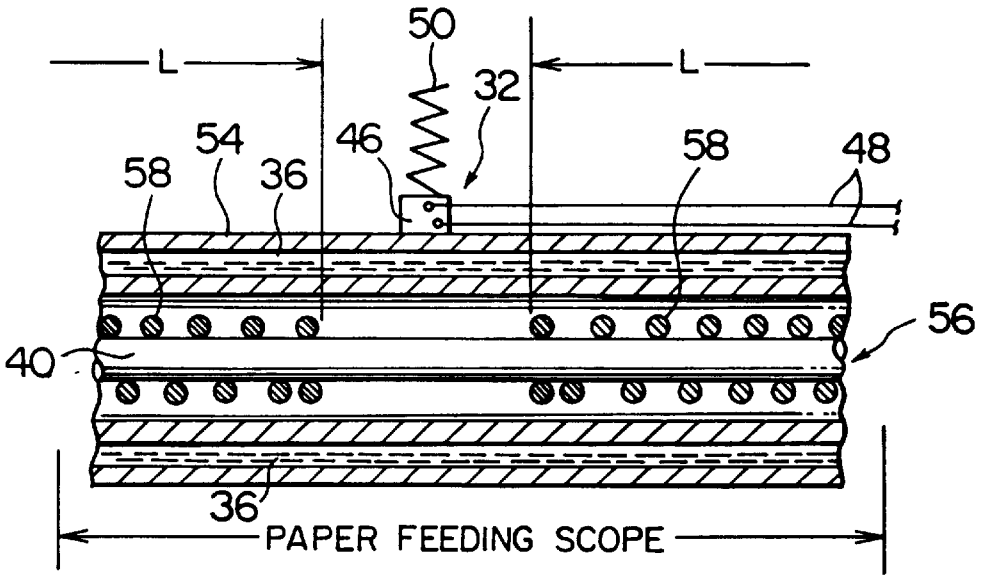
FIG. 9 is a sectional view of an essential part showing a modified example of the rotor having an induction coil inside of FIG. 7.
Figure 10:
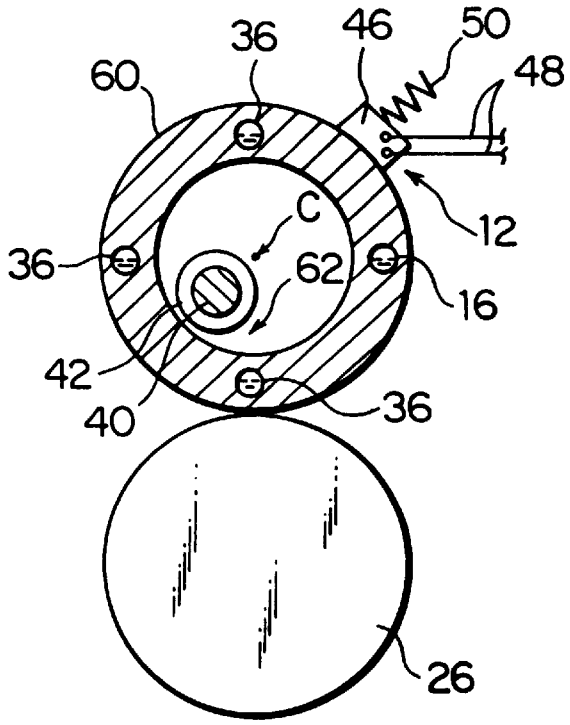
FIG. 10 is a schematic sectional view showing still another modified example of the rotor having the induction coil inside of FIG. 7.

FIG. 9 shows a modified example of the arrangement of the temperature detection means 32.

An electromagnetic induction heating mechanism 56 of a heating roller 54 shown in this embodiment has an induction coil 58 which is divided into right and left within the scope of the paper feeding scope. Corresponding to the aforementioned structure, the temperature sensor 46 which constitutes the main part of the temperature detection means 32 is arranged at a position alienated from the scope where the influence of the magnetic field is large. In the case of this embodiment, the temperature detection means 32 may be located within the scope of the axial directin of the induction coil 32.

In this manner, in a structure in which an interval is taken in a diameter direction of the heating roller 60, it is possible to hardly get an influence of the magnetic field by means of the electromagnetic induction heating mechanism 62 so that the precision of the temperature control can be improved in the same manner as in each of the aforementioned embodiments.

Figure 15A:
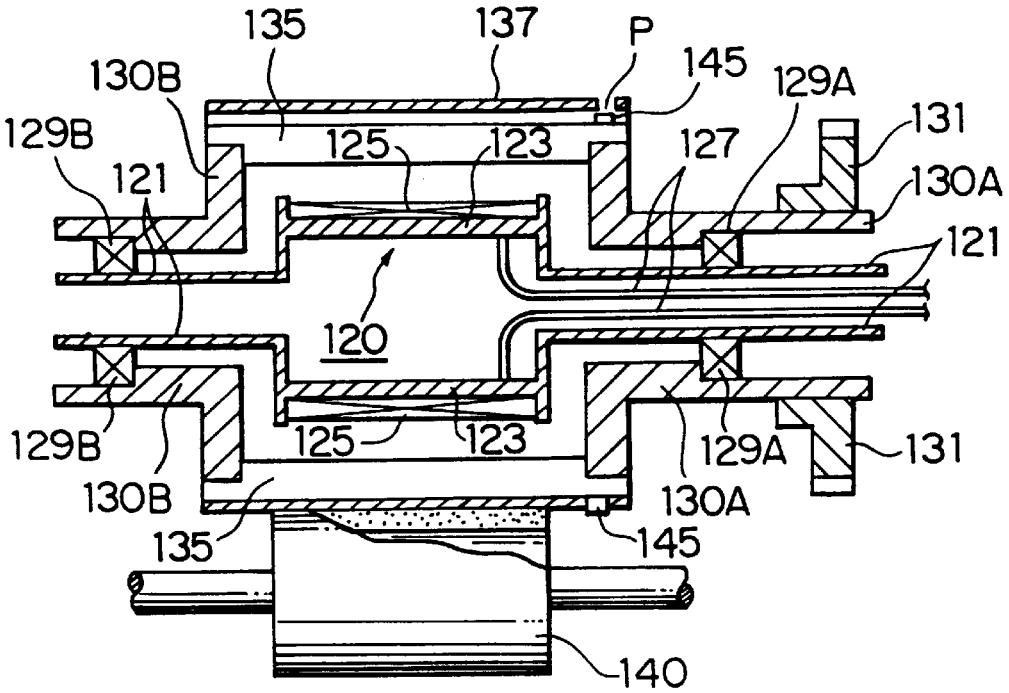
FIG. 15 is a view illustrating one embodiment according to claims 23 through 29.
Figure 15B:
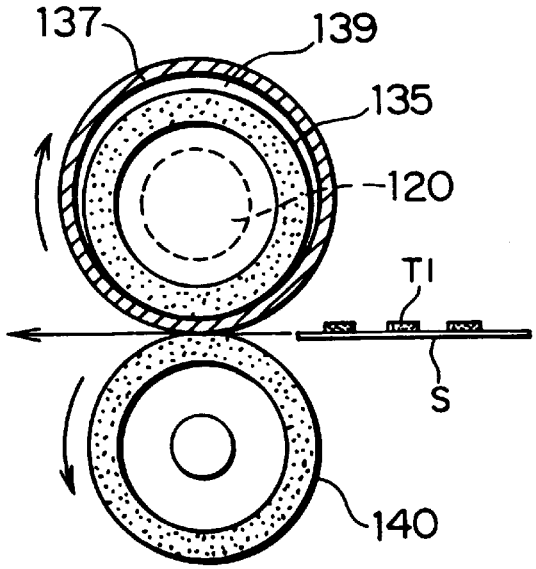
Figure 15C:
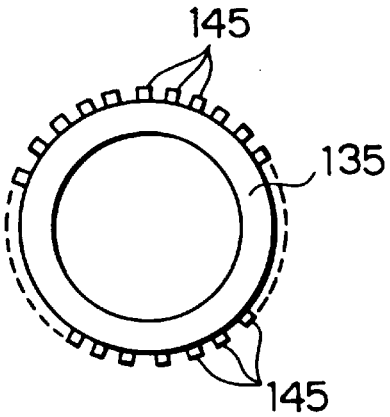

In FIG. 15, reference numeral 120 denotes a core part. The core part 120 has a fixed shaft 121 and a coil winding part 123, an induction coil 125 and a lead line 127.

The fixed shaft 121 formed of a hollow iron is provided in the device space in a fixed state and the central part thereof in the longitudinal direction is formed in a large diameter as the coil winding part 123. On the coil winding part 123, the induction coil 125 is wound and is constituted so that a high frequency current is allowed to pass therethrough via an inside of the fixed shaft 121 with the lead line 127. The fixed shaft 121 is fixed to the immobile member of the image fixing device and is immobile with respect to the device space and is not rotated.

On one end side of the fixed shaft 124, a support pipe 130A attached with a flange is provided via a rolling bearing 129A. On the other end of the fixed shaft 121, the support pipe 130B attached with the flange is provided via the rolling bearing 129B. The flange peripheral part of these support parts 130A and 130B is fit onto both ends of the axial direction of the cylindrical member 135 and is fixed to the cylindrical member 135 with the fixing means not shown such as a level or the like.

A gear 131 is fit and fixed to the support pipe 130 attached with the flange and is engaged with a driving gear not shown. By rotating the gear 131 with the driving gear, the cylindrical member 135 can be rotated around the fixed shaft 121.

The cylindrical member 135 is formed of the non-conductive heat resisting non-magnetic body. As the non-conductive non-magnetic body, PPS resin, polyimide, PBI resin, PEEK resin or the like can be used.

On the external circumferential part of the cylindrical member 135, a conductive hollow cylinder 137 having a large internal diameter larger than the external diameter of the cylindrical member is loosely fit onto the external circumference of the cylindrical member 135.

As the material of the hollow cylinder 137, each kind of metal can be used. The hollow cylinder 137 has a thin shape having a thickness of about 50 to 300 $\mu$m.

In this embodiment, the hollow cylinder 137 is formed of Ni with a thickness of about 100 $\mu$m. On the external circumferential side, a separation layer formed of fluorine resin (not shown) is formed to a thickness of 15 $\mu$m. Incidentally, preferably the thickness of the separation layer is generally 10 to 30 $\mu$m.

In FIG. 15(*a*), reference numeral 30 denotes a rotor.

FIG. 15(*b*) shows a state of the image fixing device as seen from the axial direction in an illustrative manner. FIG. 15(*a*) shows the end state of the cross section of the device taken in parallel with the upper and lower direction of FIG. 15(*a*) and vertical to the surface of FIG. 15(*a*). The core part 120 is schematically shown.

As shown in FIGS. 15(*a*) and 15(*b*), the cylindrical member 135 and the hollow cylinder 137 rotate clockwise while the rotor 140 rotates anticlockwise. The recording material having a toner image TI which is to be fixed is a transcription paper in this embodiment, and the recording material is sandwiched between the rotor having the induction coil inside and the rotor 140 and is fed in the direction of an arrow. The toner image TI is fixed with heat and pressure.

In other words, the a high frequency current is allowed to pass through the induction coil 125 (FIG. 15(*a*)) at the time of fixing so that the hollow cylinder 137 is heated with joule heat along with the induction current which is generated in the hollow cylinder 137. Since the thickness of the hollow cylinder 137 is thin generally with a thickness of 50 to 300 $\mu$m (10 $\mu$m in the embodiment described above), the heat capacity is small and the temperature rise is fast and a desired fixing temperature can be attained in an extremely short time.

Further, as shown in FIG. 15(*b*), generally a high heat resisting air layer 139 exists between the hollow cylinder 137 and the cylindrical member 135 so that the flow of the heat in the hollow cylinder 135 is effectively prevented from flowing to be lost.

Furthermore, since the separation layer (not shown) of the hollow cylinder 137 is formed on the external circumference, it never happens the toner thickly sticks to the surface of the hollow cylinder at the time of fixing the toner image TI.

Since the hollow cylinder is loosely fit to the hollow cylinder 137, an engaging means is used which is formed of the aforementioned perforation and the engaging projection group.

As shown in FIG. 15(*c*), the engaging projection 145 is projectingly provided at an equal interval in the circumferential direction of the cylindrical member 135 to form a group of engaging projections. On the other hand, a perforation (shown at reference numeral P in FIG. 15(*a*)) fitting to the aforementioned engaging projection 145 is formed in the circumferential direction of the hollow cylinder.

The engagement between the perforation and the engaging projection 145 appears only "in the vicinity of the fixing part" where the hollow cylinder 137 is pressed against the rotor 140. With such an engagement, the hollow cylinder rotates with certitude. Incidentally, the engaging means formed of the perforation and the engaging projection group is provided only on one end of the longitudinal direction of the rotor having the induction coil inside as shown in FIG. 15(*a*) in the embodiment shown in FIG. 15. Naturally, the engaging means may be provided on both end parts (outside of the fixed width) of the longitudinal direction of the rotor having the induction coil inside. The transmission of the rotating force to the hollow cylinder is secured by providing the engaging means on both ends thereof.

Figure 16:
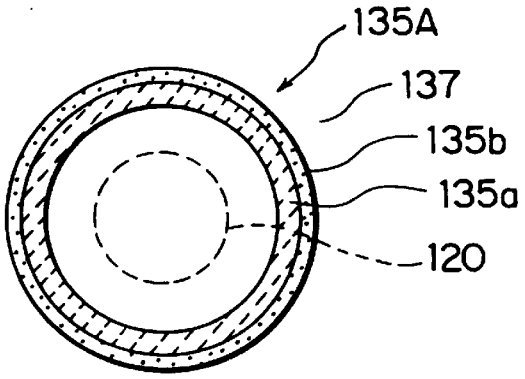
FIG. 16 is a view showing only a characteristic part of another embodiment according to claims 23 through 29.

FIG. 16 shows only the characteristic part of one embodiment described in claim 26.

The cylindrical member 135A forms a heat resisting elastic layer 135*b* on the external circumference of a tube-like shape body formed of heat-resisting resin. As a heat resisting resin constituting the tube-like shape body 135*a*, polyimide, PPS resin, PBI resin, PEEK resin or the like are preferable. The tube-like shape body 135*a* is formed to a thickness having a desired mechanical strength with an appropriate materials.

The heat resisting elastic layer 135*b* is formed of silicone rubber, fluorine rubber or the like to an appropriate thickness.

When the cylindrical member 135*a* is formed in this manner, a large friction power acts between the external circumference of the heat resisting elastic layer 135*b* and the hollow cylinder (not shown), the hollow cylinder can be rotated with certitude by using as an engaging means a friction connection between the heat resisting elastic layer and the internal surface of the hollow cylinder without using a mechanical engaging means having a shape as shown in FIG. 15.

In the embodiment shown in FIG. 16, the structure of the heat resisting elastic body which constitutes the heat resisting elastic layer 135 is solid. When the structure is formed of foaming body, the heat generated in the hollow cylinder is conducted only with difficulty to the side of the cylindrical member as described above so that the loss of fixing heat is small.

Along with the repetition of the fixing of the toner image, deposition toner is gradually deposited on the separation layer of the external circumference of the hollow cylinder with the result that the separation layer will not work in the end. In such a case, the rotor having the induction coil must be replaced. The replacement can be sufficiently replaced only with the hollow cylinder. The hollow cylinder is loosely fit with the cylindrical member so that the hollow cylinder can be removed and the removal thereof can be easily carried out.

Figure 17:
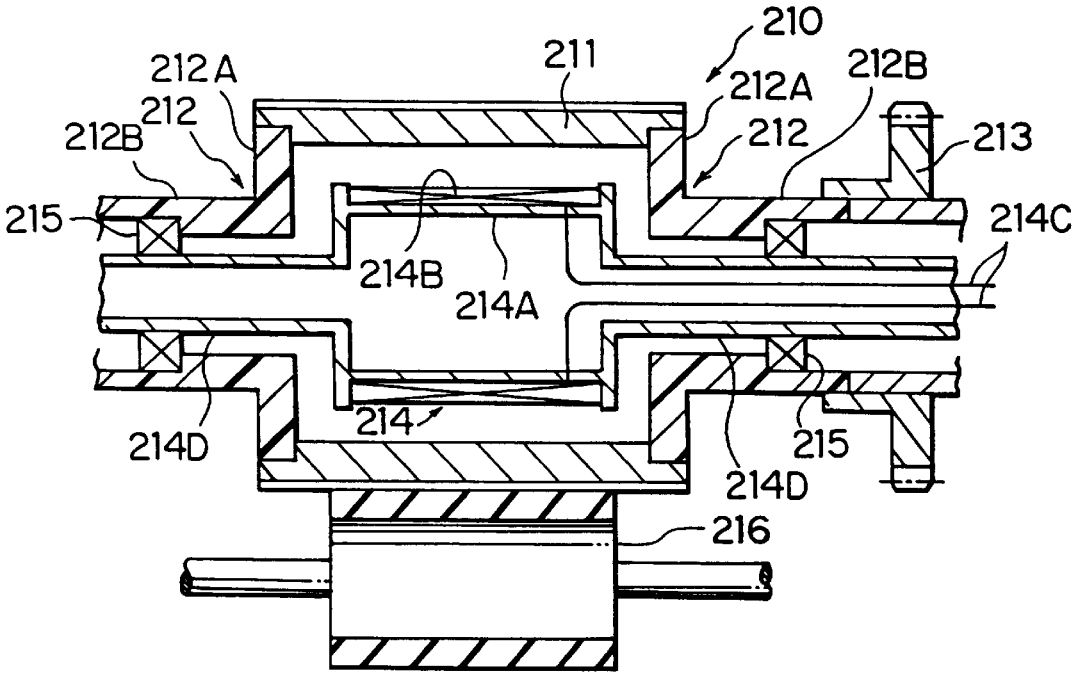
FIG. 17 is a sectional view showing a basic structure of the rotor having an induction coil inside according to claims 30 through 32.

FIG. 17 is a sectional view showing an image fixing device having the rotor having the induction coil inside. The embodiment is characterized in that the rotor having the induction coil inside has a heat insulation property. Here, a support part refers to the flange. In addition, FIG. 17 is a sectional view showing the rotor having the induction coil inside according to an embodiment of the invention.

In FIG. 17, the rotor having the induction coil inside provides an external cylinder 211 and an end plate (referred to as flange hereinafter) which is integrated at each end part in the axial direction.

The external cylinder 211 is a good heat conductor formed of metal, and the flange 212 is fixed to both ends in the axial direction. The external cylinder itself 211 may have magnetic properties and may be non-magnetic.

The flange 211 comprises an end plate 212A which seals both ends in the axial direction of the external cylinder, and an axial cylinder part 212B which is integrated to the end plate. To one end of the shaft cylindrical part 212B, a driving gear 213 is connected.

The rotation force from the driving source not shown is transmitted to the driving gear 213 so that the rotor having the induction coil inside is rotated in a direction in which the recording material such as the transcription paper or the like can be fed.

Inside of the rotor having the induction coil inside, the induction heating mechanism is arranged which is constituted by winding the coil 214B on the core of the magnetic body.

The induction heating mechanism 214 is constituted so that the coil 214B is positioned at a position opposite to the internal circumferential surface of the external cylinder 211, and the lead line extending from the end of the coil 214B is connected to the power source part not shown.

The induction heating mechanism 214 has a shaft cylinder part 214D, and the shaft cylinder part 214C is connected in the shaft cylinder part 212B of the flange via the bearing 215. As a consequence, the induction heating mechanism is kept in a free state 212B even if the shaft cylinder part rotates.

In the induction heating mechanism 214, a magnetic field is formed when electricity passes through the coil 214B so that the rotor having the induction coil inside passes through the coil 214B. Then the rotor 210 having the induction coil inside acts on the external cylinder 211 and the induction current is generated inside of the external cylinder 211. The external cylinder 211 is heated with the generation of the induction current so that the surface temperature can be raised.

In the rotor 210 having the induction coil inside, when the surface temperature attains a level required for fixing the image, the passage of electricity to the coil 214B of the induction heating mechanism 114 is shielded. Furthermore, when the surface temperature does not attain the temperature, electricity passes through the coil 214B until the temperature is attained so that the surface temperature is maintained on a definite level. Consequently, in the vicinity of the rotor having the induction coil inside, a temperature sensor not shown is arranged. A temperature detection signal is output to a control part (not shown) to which the aforementioned coil is connected so that the feedback control is carried out for maintaining the surface temperature on a definite level.

The flange 212 which is integrated with the external cylinder of the rotor having the induction coil inside is formed of a heat insulating material which is non-magnetic and has a heat resistance.

As a heat insulating member, non-magnetic resin materials such as polyethylene, terephthalate (PET), polybutyleterephthalate (PBT), and polyamide or the like is used. Furthermore, an aluminum having a non-magnetic property may be used to raise heat efficiency without generating heat in the flange part.

The rotor 210 having the induction coil inside is constituted so that the rotor 210 sandwiches and feeds the recording material such as the transcription paper or the like together with rotor 216 located opposite to the rotor 210.

Since the present invention is constituted in this manner, electricity passes through the coil 214B at the time of setting the surface temperature of the rotor 210 having the induction coil inside to a level required for fixing the image.

When electricity is allowed to pass through the coil, current is induced in the external cylinder under the influence of the magnetic field which is generated in the surrounding, and the external cylinder generates heat with the heat action of the current.

The heat generated in the external cylinder is not limited to the surrounding of the surface of the external surface, but is generated in all the area in the axial direction of the external cylinder.

The end part in the axial direction in the external cylinder 211 of the rotor 210 having the induction coil exhibits a remarkable heat radiation as compared with the center in the axial direction. However, in the embodiment, since a flange 211 having heat insulation is arranged at the end part in the axial direction of the external cylinder 211, heat transmission from the end part in the axial direction is suppressed. Consequently, the temperature distribution is uniformed over all the areas in the axial direction of the rotor having the induction coil inside.

Next, further embodiment will be explained. Incidentally, it is explained in advance that like reference numeral is used to denote like constituent parts which is the same as one shown in FIG. 17.

Figure 18:
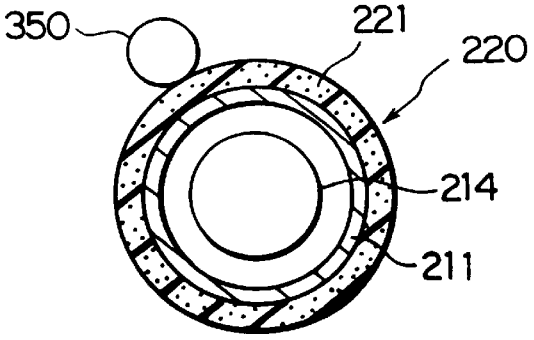
FIG. 18 is a schematic view showing one embodiment according to claim 33.

FIG. 18 is a sectional view showing one embodiment of the rotor having the induction coil inside. The rotor 220 having the induction coil inside shown in FIG. 18 is characterized in that an elastic layer having magnetic property on the external layer is provided.

In FIG. 18, an elastic body 211 is provided on the external surface of the external cylinder 210. This elastic body 221 is used for expanding a contact surface with respect to an image on the recording material, and the elastic body is formed of a magnetic body.

In order to provide a magnetic property in the elastic body such as rubber or the like which is a non-magnetic body, normally either magnetic powders are scattered or a conductive rubber is used so as to lower the resistance value to an electric resistance which allows the induction current to flow. A conductive material including metal serves as the magnetic powders in this case. Incidentally, in FIG. 18, reference numeral 350 denotes a roller applied with a separation agent.

Since the embodiment has the aforementioned structure, in an explanation in which the rotor having the induction coil inside shown in FIG. 17 is replaced with the rotor 220 having the induction coil inside, current is induced in the external cylinder 211 located opposite to the coil 214B so that the external cylinder generates heat with the passage of electricity through the coil 214B in the induction heating mechanism 214.

On the other hand, since the elastic body 221 having a surface layer which is integral with the external cylinder 211 is a magnetic body like the external cylinder 211, current flows inside and heat is generated with the heat action of the current. Consequently, since the surface layer of the rotor having the induction coil inside which directly contacts the recording material generates heat, the heat efficiency is improved and the heat fixing of the image incorporated in the recording material can be promoted.

A further embodiment of the invention will be explained.

Figure 19:
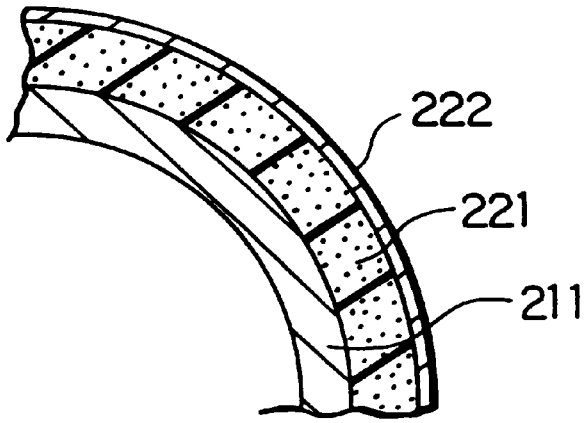
FIG. 19 is a local sectional view for explaining an embodiment of the rotor having an induction coil inside according to Claim in claims 34 and 35.

FIG. 19 is a local sectional view showing one embodiment of the rotor having the induction coil inside. The embodiment is characterized in that the rotor having the induction coil inside is provided with the separation layer comprising high polymer material on a contact surface with the recording material.

In FIG. 19, the rotor having the induction coil inside is provided with an elastic body on the surface of the external cylinder. A separation layer 222 formed of high polymer material such as Teflon (product name) or the like is joined with the surface layer, namely, the surface which contacts the recording material of the transcription paper.

For the surface of the rotor having the induction coil inside, an elastically deformable member is used to favorably transmit heat to the recording material by increasing a contact surface with the recording material. However, when rubber is used as an elastic body, the transition of the developing agent, particularly, the toner in the image which is impregnated in the recording material is conspicuous, and the transited toner is deposited to the recording material to damage the recording material.

In this embodiment, the separation layer comprising high polymer material for preventing the deposition of toner with an extremely high separation is provided on the surface layer of the elastic body corresponding to the surface which contacts the recording material.

As a structure of the separation layer 222, a tube wound around a surface of the elastic body 221 with a thickness of 30 to 110 $\mu$m or a deposited thin layer is used.

According to the embodiment, the provision of the separation layer 222 on the surface layer of the rotor having the induction coil can eliminate the need of work such as separation agent application which is conventionally used and the structure for the application.

Next, one further embodiment will be explained.

The embodiment is characterized by using a magnetic body in the separation layer which is provided on the surface layer of the elastic body in the rotor having the induction coil inside.

In FIG. 19, a separation layer 222 formed of high polymer material such as Teflon (product name) or the like is provided on the surface of the elastic body 221. The separation layer 222 is formed of a magnetic body. To provide a magnetic property in the separation layer, magnetic powders are scattered or magnetic powders are mixed so as to lower the resistance value to an electric resistance which allows induction current to flow.

Since the embodiment is constituted in the aforementioned manner, induction current is induced in the external cylinder located opposite to the coil 214B with the passage of electricity through the coil 214B so that heat is generated with the heat action of the current.

On the other hand, current flows inside of the separation layer 222 which constitutes the elastic body which is integral with the external cylinder 211 and a surface layer of the elastic body 221 so that heat is generated with the heat action of the current. Consequently, the rotor having the induction coil inside which provides the separation layer preventing the transition of the toner in a direct contact with the recording material can improve the heat efficiency while maintaining the separation property with the heating of the separation layer 222 itself with the result that the heat fixing of the image can be promoted.

Next, one further embodiment will be explained.

The embodiment is characterized in that a magnetic layer with magnetic property is provided on the surface of the rotor having the induction coil inside to apply pressure to closely attach the recording material to the rotor having the induction coil inside which is used in the fixing device.

Figure 20:
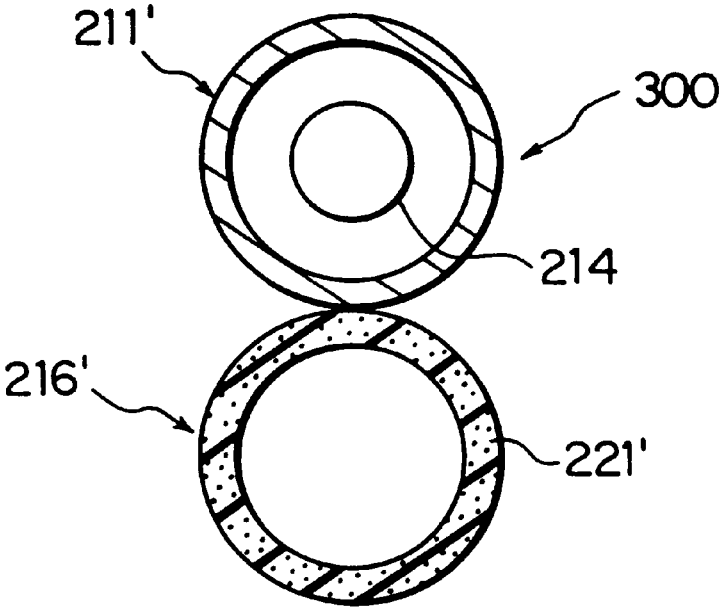
FIG. 20 is a schematic view showing one embodiment of the invention according to claim 36.

In FIG. 20, the image fixing device 300 comprises a rotor having an induction coil inside (denoted at reference numeral 211 for the sake of convenience) and another rotor (denoted at reference numeral 216 for the sake of convenience) located opposite to and in contact with the rotor 211, the rotor 211 comprising a tube-like metal roller incorporating an induction heating mechanism 214.

An elastic body 221 such as rubber or the like is arranged on the surface which can contact with the recording material, and the elastic body has a magnetic property.

The elastic body 221 located on the surface of the other rotor can be formed by scattering magnetic powders in the rubber which is a basic material or mixing magnetic powders at the time of vulcanizing rubber.

Since the embodiment is constituted in such a manner, the external cylinder generates heat with the passage of electricity through the induction heating mechanism in the same manner as shown in FIG. 17.

On the other hand, on the surface layer of the other rotor 216, the elastic body 221 is affected by the influence of the magnetic field by the current generated in the external cylinder 211, and the temperature rises with the heat action off the current. With such a structure, the elastic body 221 located on the surface layer of the other rotor functions as a heating body.

In accordance with the embodiment, since the other rotor 216 itself serves as a heating body in addition to the rotor 210, the temperature gradient can be reduced between the two rotors unlike the case in which the conventional non-magnetic roller is used. Consequently, the time until the temperature required for fixing can be shortened so that the temperature rise can be improved with this.

One further embodiment will be explained.

The embodiment is characterized in that a magnetic property is provided in the elastic layer when the induction heating mechanism and the elastic layer are provided on the rotor.

Figure 21:
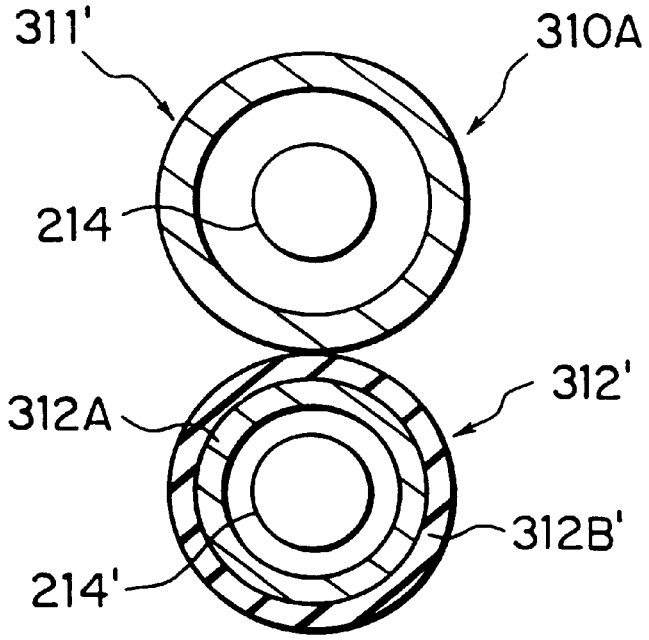
FIG. 21 is a schematic view for explaining one embodiment of the invention according to claim 40.

In FIG. 21, the rotor (denoted at reference numeral 312) having the induction coil inside comprises an external cylinder (denoted at reference numeral 312A' for the sake of convenience), an elastic layer (denoted at reference numeral 312B' for the sake of convenience) and an induction heating mechanism (denoted at reference numeral 214') which is arranged inside of the external cylinder 312A'.

A rubber having a magnetic property is used in the elastic layer 312B'. In order to provide a magnetic property in the elastic body such as rubber or the like, magnetic powders are scattered in the rubber which is the basic material and magnetic powders can be mixed at the time of vulcanizing powder.

According to the embodiment, the temperature rise on the contact surface with the recording material in the rotor having the induction coil inside can be improved.

Figure 22:
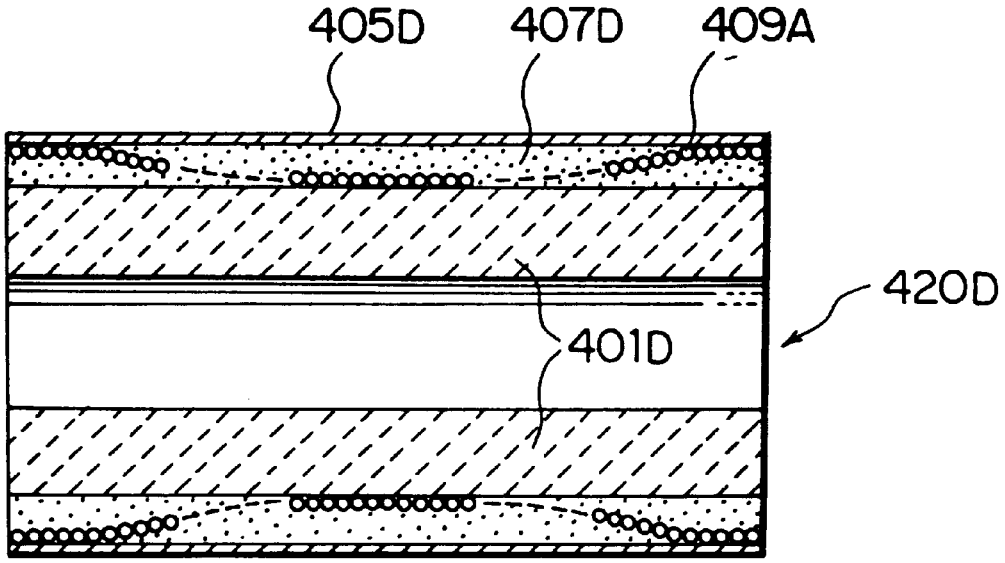
FIG. 22 is a view for explaining a form of the embodiment of the invention according to claim 39.

FIG. 22 is a view illustrating an embodiment of the rotor having the induction coil inside, the view showing a structure of a hollow roller which characterizes the invention.

The hollow roller 420D has a heat resisting elastic layer 407D and a separation layer 405D in this order on the external circumference of the hollow cylinder 401D formed of non-conductive heat resisting heat insulation rigid material. Inside of the heat resisting elastic layer 407D, there is provided a layer-like heating part 409A formed by closely winding the elongated conductor in a spiral manner. In this form, a plurality of layers of linear conductors may be wound.

Like an embodiment shown in FIG. 22, a winding diameter of an elongated linear conductor increases from the central part in the longitudinal direction of the hollow roller to both end parts so that the linear conductor can be located in the vicinity of the external circumference of the hollow roller at both end parts.

To form such a hollow roller, a heating part is arranged in the circumferential surface of the hollow cylinder 401D and the heating part is placed into a cylinder-like mold and a liquid-like rubber is poured in, vulcanizing the rubber, cooling and caking the rubber to form the heat resisting elastic layer.

Figure 23:
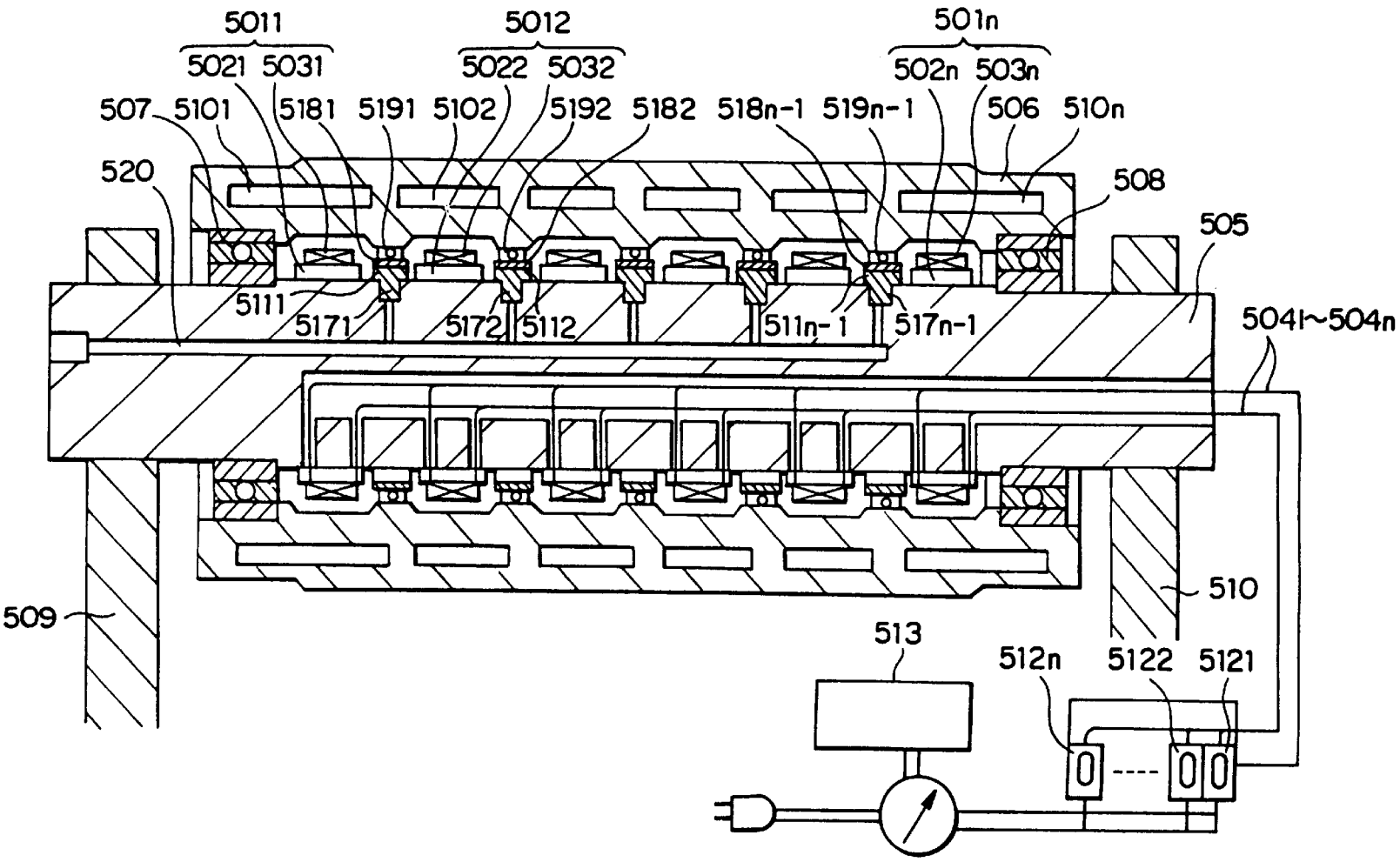
FIG. 23 is a sectional view showing a form of the embodiment according to claims 41 and 44.

FIG. 23 shows one further embodiment of the image fixing device. The invention is one embodiment of the image fixing device using a rotor having the induction coil inside, the device being used in image forming apparatuses such as a copying machine, a facsimile machine, a printer or the like. Furthermore, the embodiment is one embodiment of the rotor of the invention. In this embodiment, two or more independent induction heating mechanisms 5011 to 501*n* are constituted by winding the induction coils 5031 to 503*n* around iron cores 5021 to 502*n*. The induction heating mechanisms 5011 to 501*n* are independently arranged in a predetermined interval in an axial direction on a fixed shaft 505 incorporating electric wires 5041 to 504*n* for allowing electricity to pass through the induction coil 5031 to 503*n*.

The conductive cylinder-like roller 506 formed of a magnetic material and constituted so that the inside is hollow is rotatably provided on the fixed shaft 505 with bearings 507 and 508. Both end parts of the fixed shaft 505 are fixed to a pair of device bases 509 and 510. The induction heating mechanisms 5011 to 501*n* are provided inside of the roller 506. The roller 506 is provided with two or more jacket chambers 5101 to 510*n* along with an axial direction independently at a position located opposite to the induction heating mechanisms 5011 to 501*n*.

Two-phase thermal carrier in a liquid and a gas state is charged in the jacket chamber, and each induction heating mechanism 5011 to 501*n* are mutually independent of each other with bushes 5111 to 511*n*. The fixed shaft 505 is attached with a cylinder so that the cylinder is positioned between respective iron cores 5021 and 502*n* , and pistons 5171 to 517*n*-1 which are operated with hydraulic pressure is inserted into the cylinder. At the end of this piston 5171 to 517*n*-1, bushes 5111 to 511*n*-1 are provided and the bearing mechanism comprises internal cylinders 5181 to 518*n*-1 embedded in the bushes 5171 to 517*n*-1 and rolling elements comprising rolls arranged between the external circumferences and the internal circumferences.

In addition, a hydraulic pressure orifice 520 communicating to the aforementioned cylinder is provided on the fixed shaft 505 so that a force is applied in a direction of pressing the piston 5171 to 5171*n*-1 outside with a working oil with a definite pressure which is supplied through the hydraulic pressure oil. As a consequence, force is applied to press the roller outside from pistons 5171 to 517*n*-1 via bushes 5111 to 511*n*-1, internal cylinders 5181 to 518*n*-1, and rolling elements 5191 to 519*n*-1.

Mutually independent power sources 5121 to 512*n* are connected to induction coils 5031 to 503*n* of the induction heating mechanisms 5011 to 501*n* via respective electric wires 5041 to 504*n*. The induction coils 5081 to 508*n* are driven with alternating current to generate alternate magnetic flux. The roller 506 generates joule heat with the flow of the induction current from the alternating magnetic flux by the induction coils 5031 to 503*n*. In other words, the induction coil induces and generates heat so that the surface temperature will be uniform with the thermal carrier in the jacket chambers 5101 to 510*n*.

The passage amount of electricity from each of the power sources 5121 to 512*n* to the induction coils 5031 to 503*n* is controlled and determined with the controller 513 with the result that the heat amount on the surface of the roller is independently determined for each induction heating mechanism. The power sources 5121 to 512*n* can be set by rendering variable the passage amount of electricity to respective induction coils 5031 to 503*n*. By making use of a quick rise of temperature which is characterized by the induction heating, the heating amount of the roller surface 506 can be switched for each of the induction heating mechanisms 5011 to 501*n* in a moment.

The rotor having the induction coil inside in the image fixing device according to the invention is used in the fixing roller in the heating and fixing device. In this heating and fixing devices two rotors are mutually pressed against each other with a pressure applying means such as a spring or the like. Image forming apparatuses such as a copying machine, a facsimile machine, a printer and the like form a toner image on a recording material from a paper feeding device at an image forming part with an image signal obtained by reading the image with the image reading means and an image signal from the outside. When the recording material on which the toner image is formed passes through the nip part, the toner image is fixed with heating by the rotor having the induction coil inside.

In this manner, this embodiment is one embodiment. In the image fixing device of this embodiment comprising providing a rotor having an induction coil inside, the rotor rotatably constituted and comprising a roller 506 having a jacket chamber in which a thermal carrier is charged and an induction heating mechanism provided inside of the roller 506 and inducing and heating the roller 506, the induction heating mechanism comprises at least two or more induction heating mechanisms 5011 to 501*n* which are arranged in an axial direction of the roller 506 and independently allow electricity to pass therethrough, and the jacket chamber comprises at least two or more jacket chambers 5101 to 510*n* which is arranged in the axial direction of the roller 506 at a position opposite to two or more induction heating mechanisms in a circumferential direction. Consequently, the roller can be partially and arbitrarily swollen and shrunken so that the deflection amount of the roller can be sufficiently corrected and the paper feeding stability can be improved.

This embodiment is one embodiment. In the image fixing device, power sources 5121 to 512*n* are provided as means of rendering variable the passage amount of electricity which is allowed to pass therethrough independent of the two or more induction heating mechanisms so that the heating distribution and the uneven configuration can be arbitrarily changed depending on the image forming conditions so that the deflection amount of the roller can be sufficiently corrected, and the paper feeding stability can be improved.

Figure 24:
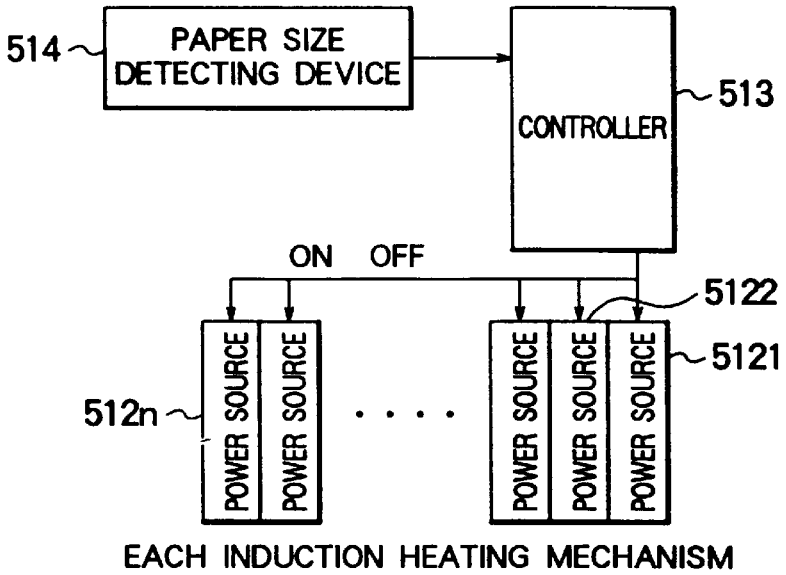
FIG. 24 is a block diagram showing a part of the embodiment of the invention according to claim 45.

FIG. 24 shows one further embodiment. In this embodiment, known paper size detecting means for detecting the size of the recording material which is fed from the paper feeding device to the heating and fixing device is provided in the image forming apparatus. Then the controller 513 turns off with a recording material size detection signal from the recording material size detection device the power which is allowed to pass through the induction heating mechanism for inducing and heating a part which does not allow the paper to pass therethrough (part where the paper does not pass) on the roller out of the induction heating mechanisms 5011 to 501*n* with respect to the power sources 5121 to 512*n*, and the power source is turned on which is allowed to pass through the induction heating mechanism for inducing and heating a part which allows paper to pass therethrough on the roller 506 (part where paper passes) out of the induction heating mechanisms. Consequently, wasteful consumption of power is eliminated and an attempt can be made to save energy.

In this manner, this embodiment is one embodiment. In the image fixing device, the recording material size detection device 514 for detecting the size of the recording material on which the toner image is fixed, and a controller 513 are provided, the controller serving as means for allowing electricity to pass through the induction heating mechanism corresponding to the size of the recording material detected by the recording material size detecting means 514 out of the two or more independent induction heating mechanisms 5011 to 501*n*. Consequently, in parts other than the size of the recording material of the roller, energy can be saved without generating heat.

Figure 25:
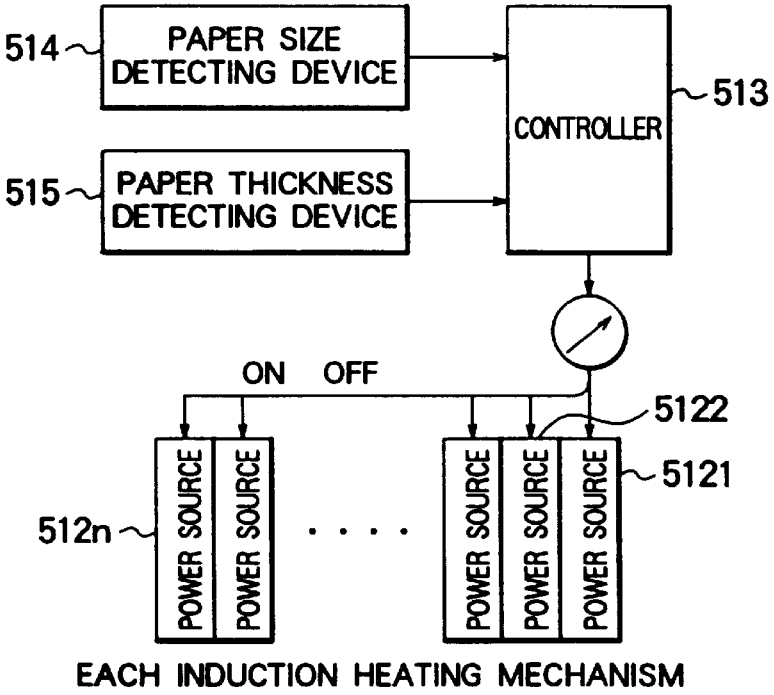
FIG. 25 is a block diagram showing part of the embodiment of the invention according to claim 46.

FIG. 25 is one further embodiment. When thick paper is generally used, the recording material is wrinkled with difficulty, and the convex shape (wrinkled state) may be small. Furthermore, a stable paper fixing property and the paper feeding stability can be secured.

Then, in the embodiment, a known recording material detecting device 515 for detecting the thickness of the recording material which is fed from the paper feeding device to the heating and fixing device is provided in the image forming apparatus. Then the controller 513 controls the power sources 5121 to 512*n* on the basis of the recording material size detection signal and the recording detection signal from the recording material detection device 515 so that a difference Δ in the passage amount of electricity between the passage amount of electricity at the induction heating mechanism at both end parts in the widthwise direction and the passage amount of electricity at the induction heating mechanism in the central part in the widthwise direction and the passage amount of electricity at the induction heating mechanism becomes the most suitable difference Δ in the passage amount of electricity and the most suitable passage amount of electricity to generate heat most suitable to the induction heating mechanism 5011, the size of the recording material and the thickness of the recording material.

With such a structure, the surface of the roller 506 assumes the most suitable heating amount and the most suitable drum-like configuration instantly with the property of the induction heating, and a stable fixing property and the recording material stability can be secured. Here, for example, the drum-like configuration of the roller serves as means for applying pressure of the nip part in the direction of expanding the recording material which passes through the nip part of the two rotors and is effective for the wrinkle of the recording material. Even if the drum-like configuration is large or small, the wrinkle of the recording material is generated. However, when the surface of the roller assumes the most suitable heating amount and the most suitable drum-like configuration, the recording material does not generate wrinkles and a stable fixing property and the recording material feeding stability can be secured.

Furthermore, in another embodiment and the embodiment shown in FIG. 25, a known paper thickness designation device for designating the thickness of the recording material by the user is used in place of the recording material detecting device 515 in place of the recording material detection device 515.

In this manner, the embodiment comprises means 515 for detecting or designating a thickness of a recording material on which a toner image is to be fixed and a controller as means for changing a difference in the passage amount of electricity between the induction heating mechanism at both end part in the widthwise direction and the induction heating mechanism in the central part in the widthwise direction out of two or more independent induction heating mechanisms corresponding to the thickness of the recording material detected or designated by the means so that the induction heating mechanisms can generate heat which is suitable to the thickness of the recording material with the result that the roller suitably swells or shrinks and stable fixing property and a recording material stability can be secured, and energy can be saved.

Figure 26:
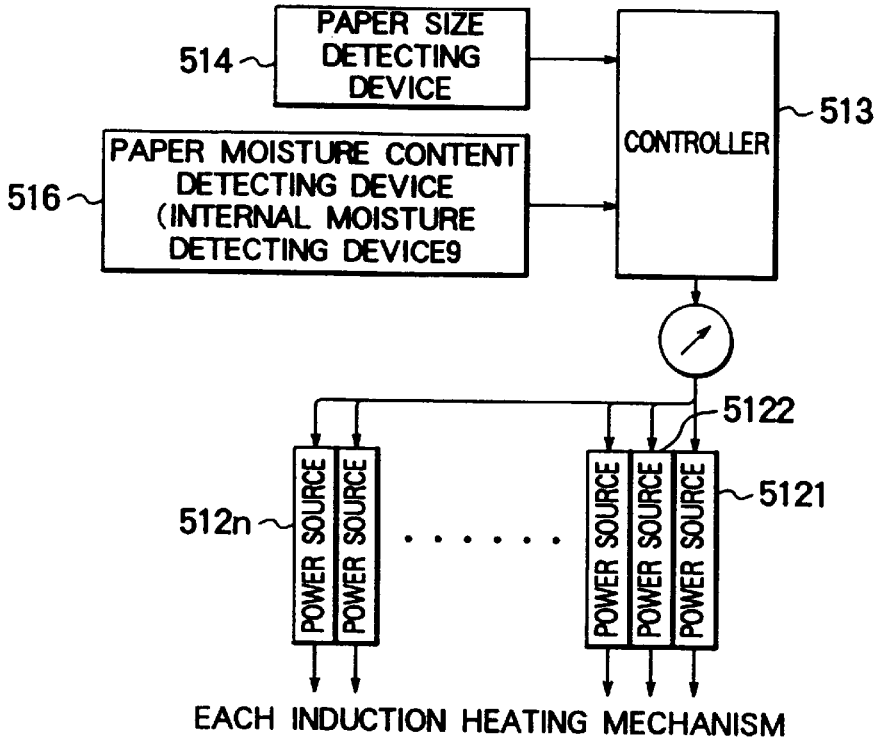
FIG. 26 is a block diagram showing part of the embodiment of the invention according to claim 47.

FIG. 26 shows one further embodiment of the invention. Generally, the recording material containing moisture is likely to generate wrinkle. Consequently, the larger the drum-like configuration of the roller 506, the feeding of the recording material is stabilized. However, when the recording material containing a normal amount of moisture is fed to the roller 506 having a large wrinkle configuration, wrinkles in the opposite direction will be generated in the recording material.

Therefore, in the embodiment, a known recording material moisture detection device for detecting moisture content in the recording material which is fed from the paper feeding device to the heating and fixing device is provided on the image forming apparatus in the embodiment shown in FIG. 24. Then the controller controls the power sources 5121 to 512*n* on the basis of the recording material size detection signal from the recording material detection device 514 and the recording material moisture detection signal from the recording material moisture detection device 516 so that a difference Δ in the passage amount of electricity between the passage amount of electricity at the induction heating mechanism at both end parts in the widthwise direction and the passage amount of electricity at the induction heating mechanism in the central part in the widthwise direction becomes the most suitable difference Δ in the passage amount of electricity and the induction heating mechanism generates heat at the heating amount which is most suitable to the size of the recording material and the moisture content in the recording material.

With such a structure, the surface of the roller assumes the most suitable heating amount and the most suitable drum-like configuration instantly with the property of the induction heating, and a recording material feeding stability can be secured. Here, for example, the recording material having smaller size generates wrinkles with greater difficulty. However, the wrinkles are generated even on the recording material having smaller size owing the factors such as slits or the like. The most suitable drum-like configuration of the roller differs depending on the size of the recording material. In this fifth embodiment, a difference in the passage amount of electricity between the passage amount of electricity at the induction heating mechanism at both end part in the widthwise direction and the passage amount of electricity at the induction heating mechanism in the central part in the widthwise direction out of the induction mechanisms 5011 to 501*n* becomes the most suitable passage amount of electricity so that the induction heating mechanisms 5011 to 501*n* generate heat most suitable to the size of the recording material and the moisture content in the recording material with the result that wrinkles cease to be generated on the recording material.

Furthermore, in another embodiment of the invention, an internal moisture detection device for detecting moisture in the image forming apparatus is used in place of the recording material moisture content detecting device 516.

In this manner, the embodiment provides detecting means 516 for detecting moisture or moisture content in the recording material on which the toner image is to be fixed, and a controller 513 as means for changing a difference in the passage amount of electricity between the passage amount of electricity at the induction heating mechanism at both end parts in the widthwise direction and the passage amount of electricity at the induction heating mechanism in the central part in the widthwise direction out of two or more independent induction heating mechanisms corresponding to the detection result of the detecting means 516 so that the roller can be swollen and shrunken in the amount most suitable to the recording material condition and the recording material feeding stability can be improved and energy can be saved.

Figure 27:
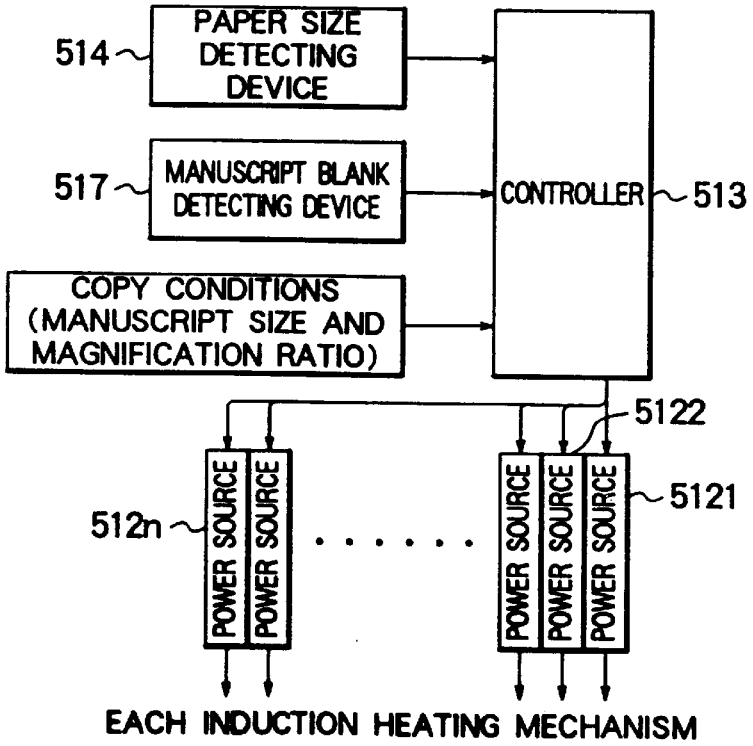
FIG. 27 is a block diagram showing part of the embodiment according to claim 48.

FIG. 27 shows part of another embodiment of the invention. In the image forming apparatuses such as a digital copying machine and facsimile copying machine, it is possible to identify where the blank of the manuscript is located on the recording material. In the analog copying machine, it is possible to identify where the blank of the manuscript is located on the recording material by means of the setting of the reduction rate of the manuscript size and the setting of the blank on the copy. It is useless to provide heat amount to the blank of the recording material to fix the toner image on the blank part of the recording paper.

Then in this embodiment, the image fixing device used in the image forming apparatus for forming the toner image on the recording material with an image formation part by reading the manuscript image with the image reading means, the device comprising a manuscript blank detection means 517 for detecting or identifying where the blank of the manuscript is located on the recording material and a recording material size detection device 514, the controller 513 calculates the time of the passage of the position on the roller corresponding to the blank part on the copy and the blank of the copy from data of image formation conditions such as the recording material size detection signal from the recording material size from the recording material size detecting device 514, a manuscript blank detection signal from the manuscript blank detection device 517, and the manuscript size and the magnification ratio from the aforementioned image forming apparatus with the result that power source is turned off which applies electricity to the induction heating mechanism for inducing and heating part of the roller where paper is not allowed to pass (part which does not allow the paper passage) in the induction heating mechanism 5011 to 501*n* with respect to the power sources 5121 to 512*n* on the basis of the calculation result, and power source is turned on which applies electricity to the induction heating mechanism for inducing and heating part of the roller where paper is allowed to pass (part which allows the paper passage) out of the induction heating mechanisms 5011 to 501*n*. With such a structure, only part of the roller which is required for fixing the toner image is heated at the time of fixing the image so that wasteful power consumption is eliminated and an attempt is made to reduce the energy.

In this manner, in the embodiment, the image fixing device is used in the image forming apparatus for forming the toner image on the recording material by reading the manuscript image comprises a manuscript blank detecting device 517 as a manuscript blank detection means for detecting the manuscript blank, and a controller 513 as means for turning on and off the passage of electricity to two or more independent induction heating mechanisms corresponding to the manuscript blank which is detected by the manuscript blank detecting means 517 so that part corresponding to the manuscript blank on the roller and an attempt can be made to save energy.

Figure 28:
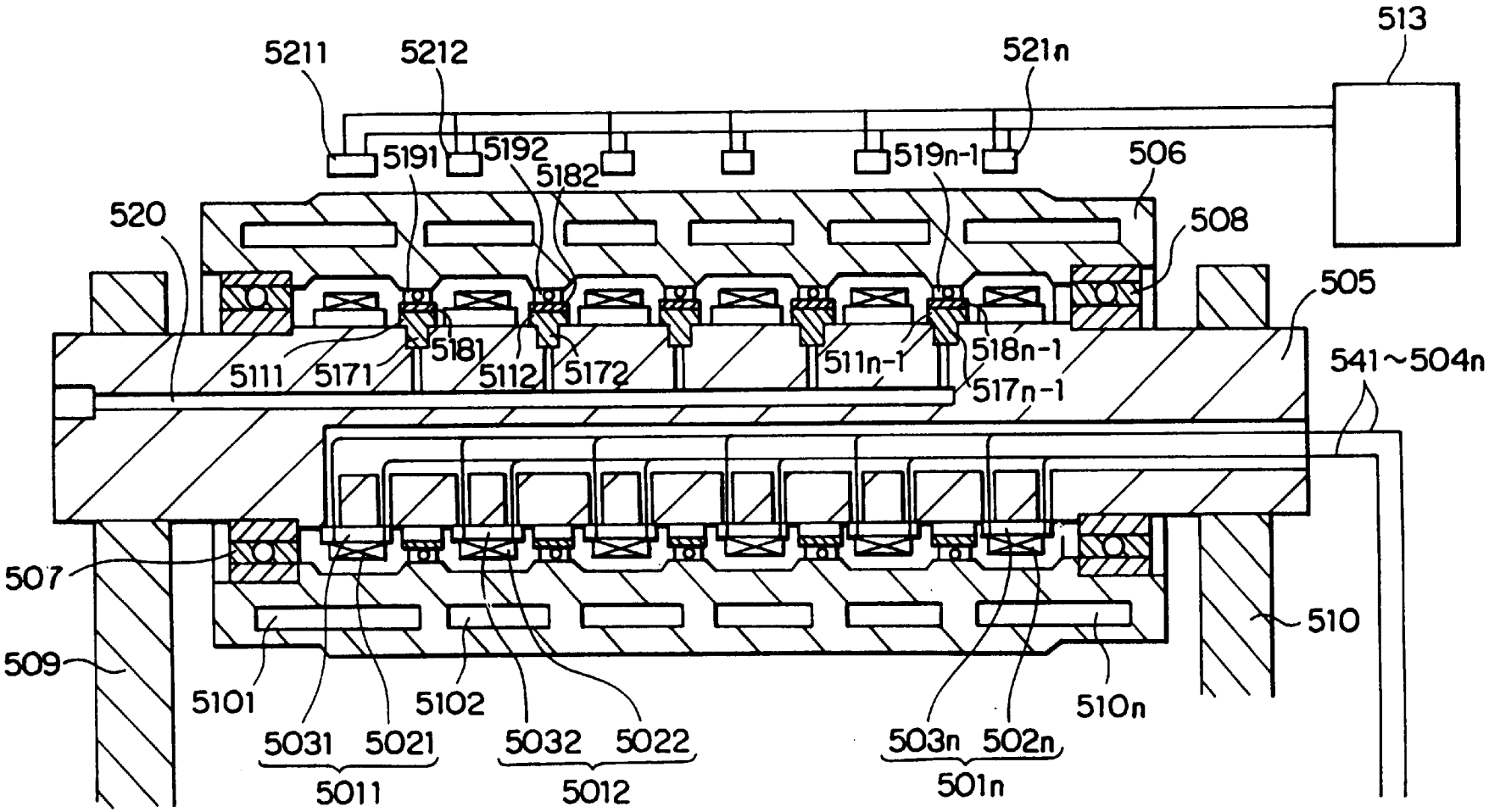
FIG. 28 is a sectional view showing an embodiment of the invention according to claim 49.

FIG. 28 shows one further embodiment. In the embodiment shown in FIG. 28, the induction heating mechanisms 5011 to 501*n* which comprises iron cores 5021 to 502*n* and induction coils 5031 to 503*n* are independent of each other in the axial direction of the roller 506 and electricity is applied to respective induction heating mechanisms with mutually independent power sources 5121 to 512*n*. Consequently, each of the induction heating mechanisms 5011 to 501*n* and each part corresponding to the jacket chambers 5101 to 510*n* are heated at independent heating amount.

Therefore, in this embodiment, temperature detection devices 5211 to 521*n* are arranged at positions located opposite to each part corresponding to each induction heating mechanisms 5011 and jacket chambers 5101 to 510*n* in the aforementioned embodiment shown in FIG. 23 to control the heating amount of each part corresponding to each of the induction heating mechanisms 5011 to 501*n* on the roller 506 with the controller 513, the temperature detecting devices 5101 to 510*n* detecting temperature at each part on the roller 506. The controller 513 controls the power sources 5121 to 512*n* with each temperature detection signals from the temperature detection devices 5211 to 521*n* so that the temperatures of each part corresponding to each of the induction heating mechanisms 5011 and 501*n* on the roller and the jacket chambers 5101 to 510*n* are set to desired temperatures so that each of the induction heating mechanisms are independently controlled.

In this manner, in one embodiment of, the induction heating roller device comprises temperature detection devices 5211 to 521*n* as at least one or more temperature detection means for detecting the surface temperature, the devices being arranged in accordance with two or more independent jacket chambers 5101 to 510*n* so that the surface temperature of the roller can be controlled independently for each part which is induced and heated with each of the induction heating mechanisms.

Figure 29:
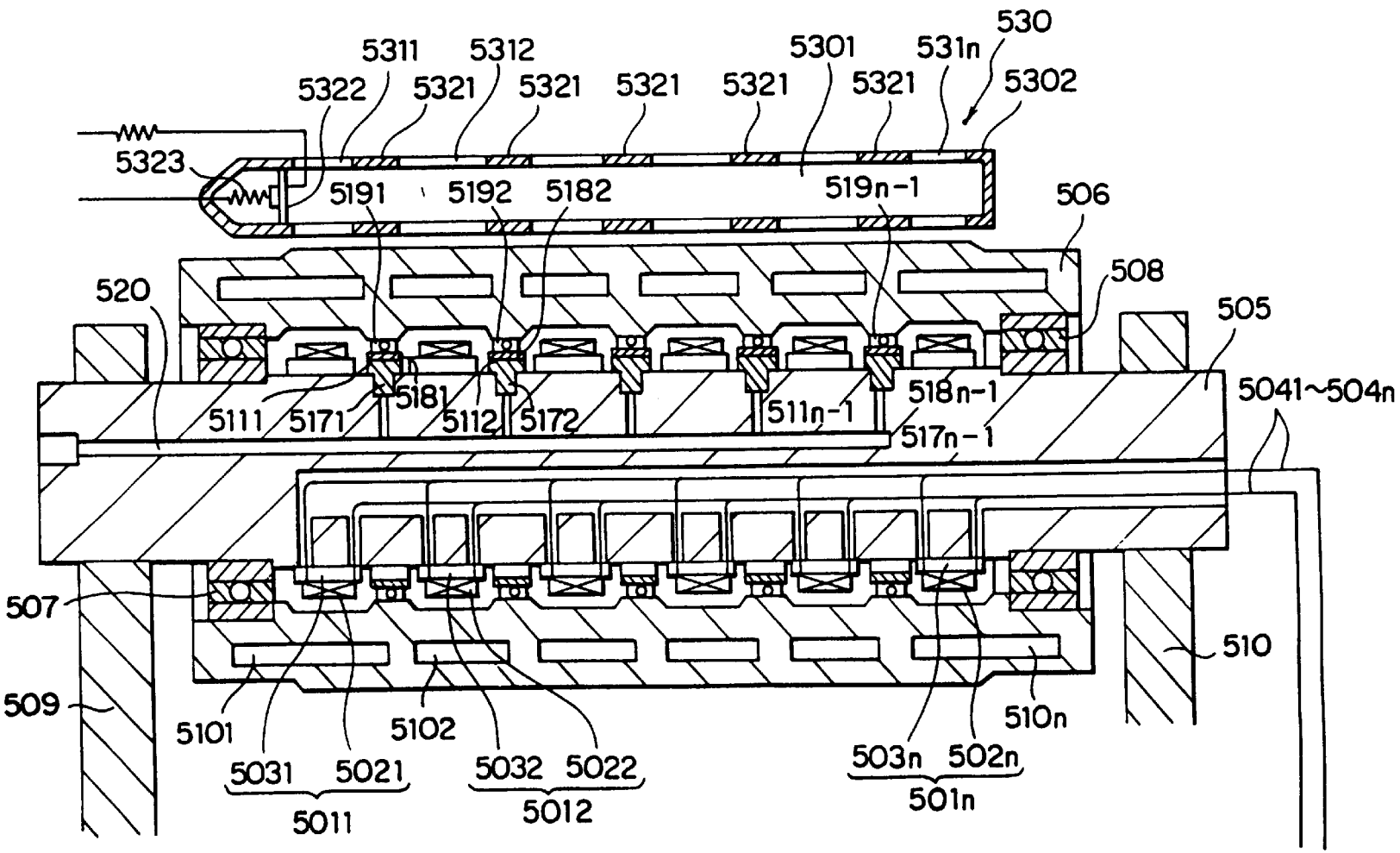
FIG. 29 is a sectional view showing an embodiment of the invention according to claim 50.

FIG. 29 shows one further embodiment. In this embodiment, each of the induction heating mechanisms 5011 to 501*n* is independent of each other in the aforementioned embodiment shown in FIG. 23 so that temperature fuses 530 for preventing the runaway of the heating of the roller 506 are arranged over all the areas of the induction heating mechanisms 5011 to 501*n*. In the temperature fuse 530, resin which is molten at a definite temperature is arranged over all the areas of the induction heating mechanisms 5011 to 501*n* in an external pipe 5302.

In the external pipe 802, part corresponding to the induction heating mechanisms 5011 to 501*n* are formed of metal cylinders 5311 to 531*n* while the other parts are formed of a cylinder 5321 comprising a heat resisting material. A resin 5301 in the external pipe 5302 is pressed against an internal side of the external pipe 5302 with a spring 5323 at a barrier wall 5322 which is movably provided on the external wall 5302 and which allows electricity to pass therethrough and wires can be connected so that a safety device can work through the barrier wall 5322 and the spring 5323 so that electricity passes therethrough.

Since the external wall 5302 is arranged over all the areas of the induction heating mechanisms 5011 to 501*n*, the heat capacity is large when the external pipe 5302 is completely formed of metal with the result that it takes time until the resin in the external pipe 5302 is molten at the time when the heating in the roller 506 runs away so that the damage done to the roller 506 becomes large. Then, the metal cylinders 5311 to 531*n* are divided to a length corresponding to the length of the induction heating mechanisms 5011 to 501*n* to suppress the heat capacity to a small level.

When the heating of the roller 506 runs away, the temperature at the metal cylinder located opposite to the heating runaway part of the roller 506 rises to an unusually high level, resin 5301 in the external pipe 5302 is molten at part inside of the metal cylinder. With such a structure, when barrier wall 5322 is regressed to the internal side of the external pipe and is separated from the spring 5322, the passage of electricity to the temperature fuse 530 is severed and the safety device works.

Thus, in the embodiment, the induction heating mechanism comprises temperature fuse 530 for detecting the surface temperature of the roller 506 over all the areas of two or more independent induction heating mechanisms 5011 to 501*n* so that the safety device can work with the temperature fuse even when any of the independent induction heating mechanism run away.

Figure 30:
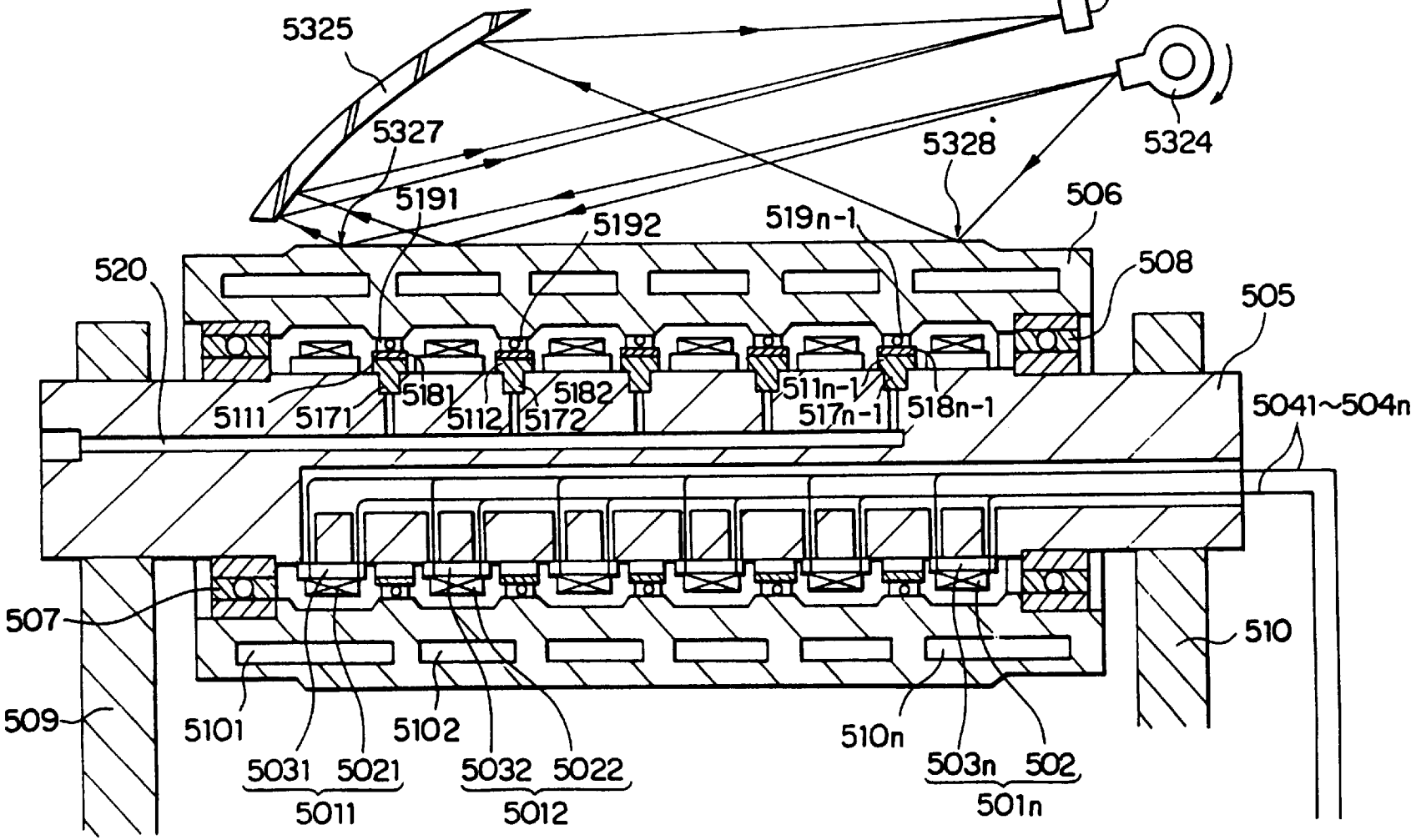
FIG. 30 is a sectional view showing one embodiment of the invention according to claim 51.

FIG. 30 shows one further embodiment. In this embodiment, temperature detection means comprising a light source 5324, a mirror 5325, and a light receiving part 5326 is used in the aforementioned embodiment shown in FIG. 23. The light source 5324 is rotated and driven with a rotation driving source not shown, and the light source is rotated in the axial direction of the roller to emit infrared rays.

The infrared rays from the light source 5324 is emitted to and reflected at the roller 506 so that the infrared rays reflected between points on the roller 506 which correspond to both end parts of the induction heating mechanisms 5011 to 501*n* are collected on the light receiving part 5326 with the mirror 5325. The light receiving part 5326 detects the light amount of the infrared rays which is received via the mirror 5325 subsequently from each part corresponding to each of the induction heating mechanisms 5011 to 501*n* and jacket chambers 5101 to 510*n* on the roller 506.

The controller 513 converts into temperatures on the roller 506 the light amount of the infrared rays from each part corresponding to each of the induction heating mechanisms 5011 to 501*n* and the jacket chambers 5101 to 510*n* on the roller 506 detected by the light receiving part 5326 with an output signal of the light receiving part 5326 corresponding to each part corresponding to each of the induction heating mechanisms 5011 to 501*n* and jacket chambers 5101 to 510*n* on the roller 506 and controls the power sources 5121 to 512*n* so that the temperature of each part corresponding to each induction heating mechanisms 5011 to 501*n* and the jacket chambers 5101 to 510*n* on the roller 506 with the aforementioned temperature on the roller 506 so that each of the induction heating mechanism 5011 to 501*n* is independently controlled. With such a structure, even when the induction heating mechanisms 5011 to 501*n* are finely divided, the temperature of each part corresponding to each of the induction heating mechanisms 5011 to

501*n* and the jacket chambers 5101 to 510*n* on the roller 506 can be measured, which eliminates the need of providing temperature detection elements in the number corresponding to the number of the induction heating mechanisms 5011 to 501*n* and an attempt can be made to reduce the cost thereof.

In this manner, in this embodiment, the image fixing device comprises temperature detection means which is rotatably provided and subsequently detects the surface temperature of the roller 506 corresponding to two or more independent jacket chambers 5101 to 510*n,* the means comprising a light source 5324, a mirror 5325, and a light receiving means 5326, so that the surface temperature of the roller can be detected even of the induction heating mechanism is small and an attempt can be made to reduce the cost.

What is claimed is:

1. An image fixing device for fixing an image by applying heat to a recording material having an unfixed toner image impregnated therein, the device having a first rotor arranged in a pressed state, a second rotor and an induction coil either inside of the aforementioned second rotor or inside of the aforementioned first rotor or both the aforementioned first rotor and the aforementioned second rotor whereby an induction current is generated in a part of either the first rotor, the second rotor, or both the first and second rotors wherein a high frequency current is allowed to pass therethrough to generate heat; the device comprising:

temperature detection means for detecting the temperature of a rotor having an induction coil inside; and control means for controlling a high frequency current which is allowed to pass through the induction coil depending on a first value, which is detected by the temperature detection means at a first time when the high frequency current is not output, and depending on a second value, which is detected by the temperature detection means and corrected at a second time when the high frequency current is output.

2. An image forming apparatus characterized by comprising the image fixing device according to claim 1.

3. An image fixing device according to claim 1 wherein the magnetic flux which is generated at the time of induction heating does not affect the temperature detection means, and the temperature detection accuracy is improved.

4. An image fixing device for fixing an image by applying heat to a recording material having an unfixed toner image impregnated therein, the device having a first rotor arranged in a pressed state, a second rotor and an induction coil either inside of the aforementioned second rotor or inside of the aforementioned first rotor or both the aforementioned first rotor and the aforementioned second rotor whereby an induction current is generated with a high frequency current which is allowed to pass therethrough to generate heat; the device comprising:

temperature over-rise preventing detection means disposed proximate to the rotor for detecting that the temperature of the aforementioned rotor has attained a predetermined level to prevent the temperature of the rotor having an induction coil inside from rising to an unusually high level; and a member which is formed of a magnetic material arranged in a vicinity of the temperature over-rise preventing detection means, and is heated by magnetic flux passing therethrough in order to enable a fast response of the temperature over-rise preventing detection means.

5. A rotor used in an image forming device for fixing an image by applying heat to a recording material having an unfixed toner image impregnated therein, the rotor having an induction coil inside which generates an induction current in a heating part of the aforementioned rotor with a high frequency current which is allowed to pass through the induction coil, the rotor comprising at least two layers of, a substrate layer, and a most external separation layer;

wherein the separation layer has a magnetic property.

6. A rotor according to claim 5, wherein the aforementioned most external separation layer has a magnetic property by including scattered or mixed magnetic powders.

7. A rotor according to claim 5, wherein the most external separation layer comprises a high polymer material mixed or scattered with magnetic powder.

8. An image fixing device for fixing an image by applying heat to a recording material having an unfixed toner image therein, the device having a first rotor arranged in a pressed state, a second rotor and an induction coil either inside of the second rotor or inside of the first rotor or both the first rotor and the second rotor whereby an induction current is generated with a high frequency current which is allowed to pass therethrough to generate heat; the device comprising:

the rotor having an induction coil inside which rotor is the rotor according to claim 5.

* * * * *

UNITED STATES PATENT AND TRADEMARK OFFICE

CERTIFICATE OF CORRECTION

PATENT NO. : 5,915,147

DATED : June 22, 1999

INVENTOR(S): Yuzou KOUNO, et al.

It is certified that an error appears in the above-identified patent and that said Letters Patent is hereby corrected as shown below:

On the title page, item [30] should be:

--[30] Foreign Application Priority Data

Dec. 5, 1995 [JP] Japan ..... 7-316643
Dec. 5, 1995 [JP] Japan ..... 7-316766
Dec. 6, 1995 [JP] Japan ..... 7-318129
Dec. 7, 1995 [JP] Japan ..... 7-318853
Dec. 7, 1995 [JP] Japan ..... 7-318947
Dec. 8, 1995 [JP] Japan ..... 7-320037
Dec. 25, 1995 [JP] Japan ..... 7-336424
Nov. 28, 1996 [JP] Japan ..... 8-317973
Nov. 29, 1996 [JP] Japan ..... 8-319206--

Signed and Sealed this

Second Day of May, 2000

*Attest:*

Q. TODD DICKINSON

*Attesting Officer*

*Director of Patents and Trademarks*